US010120344B2

(12) United States Patent
Yuen

(10) Patent No.: US 10,120,344 B2
(45) Date of Patent: Nov. 6, 2018

(54) SMARTWATCH ASSEMBLIES HAVING ANALOG DIALS WITH SPECIFIC FUNCTIONALITIES

(71) Applicant: Michael M. Yuen, Hong Kong (CN)

(72) Inventor: Michael M. Yuen, Hong Kong (CN)

( * ) Notice: Subject to any disclaimer, the term of this patent is extended or adjusted under 35 U.S.C. 154(b) by 0 days.

(21) Appl. No.: 15/836,042

(22) Filed: Dec. 8, 2017

(65) Prior Publication Data

US 2018/0101140 A1 Apr. 12, 2018

Related U.S. Application Data

(63) Continuation of application No. 15/393,903, filed on Dec. 29, 2016, now Pat. No. 9,841,735, which is a
(Continued)

(51) Int. Cl.
*G04G 9/00* (2006.01)
*G04B 19/30* (2006.01)
(Continued)

(52) U.S. Cl.
CPC ..... *G04G 9/0017* (2013.01); *G04B 19/30* (2013.01); *G04C 17/0091* (2013.01);
(Continued)

(58) Field of Classification Search
CPC .... G04G 9/0017; G04G 9/007; G04G 17/045; G04G 21/04; G04G 9/04; G04B 19/30;
(Continued)

(56) References Cited

U.S. PATENT DOCUMENTS 4,920,524 A 4/1990 Kotob
6,477,117 B1 * 11/2002 Narayanaswami .. G04G 13/026 368/224
(Continued)

FOREIGN PATENT DOCUMENTS

CN 2466690 Y 12/2001
CN 201191359 Y 2/2009
(Continued)

OTHER PUBLICATIONS

International Search Report for International Application No. PCT/IB2016/001950 dated Jul. 20, 2017, 5 pages.
(Continued)

*Primary Examiner* — Edwin A. Leon
(74) *Attorney, Agent, or Firm* — TraskBritt

(57) ABSTRACT

A smartwatch assembly may include a dial portion having a plurality of apertures extending therethrough and a circuit board having a plurality of LED modules disposed thereon. The plurality of LED modules may be oriented to emit light toward the plurality of apertures of the dial portion. The circuit board may include a control module configured to illuminate the plurality of LED modules in response to an alert and a communication module configured to interface with an electronic device wirelessly and to receive the alert. Methods of making a smartwatch assembly may include disposing a dial portion having a face plate and a plurality of hour-mark apertures extending through the face plate in a watch casing and disposing a circuit board having a plurality of LED modules disposed thereon in a watch casing, the plurality of LED modules corresponding to the plurality of hour-mark apertures.

20 Claims, 12 Drawing Sheets

Related U.S. Application Data continuation-in-part of application No. 15/078,757, filed on Mar. 23, 2016, now Pat. No. 9,671,757, which is a continuation of application No. 14/983,262, filed on Dec. 29, 2015, now Pat. No. 9,696,688.

(51) Int. Cl.
*G04G 17/04* (2006.01)
*G04C 17/00* (2006.01)
*G04G 21/04* (2013.01)

(52) U.S. Cl.
CPC ..... *G04G 9/007* (2013.01); *G04G 17/045* (2013.01); *G04G 21/04* (2013.01)

(58) Field of Classification Search
CPC .. G04B 9/007; G04B 17/045; G04C 17/0091; G04C 17/02
USPC ..... 368/241, 227, 71, 83, 88
See application file for complete search history.

(56) References Cited

U.S. PATENT DOCUMENTS

| | | | | |
|---|---|---|---|---|
| 7,646,678 | B2 | 1/2010 | Imai et al. | |
| 9,310,779 | B2 * | 4/2016 | Huh | G04G 13/021 |
| 9,377,762 | B2 | 6/2016 | Hoobler et al. | |
| 9,395,695 | B2 | 7/2016 | Kim et al. | |
| 9,671,757 | B1 * | 6/2017 | Yuen | G04B 19/30 |
| 2003/0231551 | A1 * | 12/2003 | Saylor | A61B 5/02055 368/10 |
| 2005/0243653 | A1 | 11/2005 | Lizzi | |
| 2015/0333203 | A1 | 11/2015 | Cardi et al. | |
| 2015/0364066 | A1 | 12/2015 | Djafer et al. | |
| 2016/0072430 | A1 | 3/2016 | Gilbert et al. | |
| 2016/0126407 | A1 | 5/2016 | Cardi et al. | |
| 2016/0211397 | A1 | 7/2016 | Kerzabi | |
| 2016/0269719 | A1 | 9/2016 | Gagliano | |
| 2017/0185048 | A1 | 6/2017 | Yuen | |

FOREIGN PATENT DOCUMENTS

| | | | |
|---|---|---|---|
| CN | 102368150 | A | 3/2012 |
| CN | 202975611 | U | 6/2013 |
| CN | 203587979 | U | 5/2014 |
| CN | 103913984 | A | 7/2014 |
| CN | 203930358 | U | 11/2014 |
| CN | 204166286 | U | 2/2015 |
| CN | 204536739 | U | 8/2015 |
| EP | 2951510 | A1 | 12/2015 |
| EP | 2984682 | A1 | 2/2016 |
| EP | 3000131 | A1 | 3/2016 |
| EP | 3028312 | A1 | 6/2016 |
| EP | 3063586 | A1 | 9/2016 |
| WO | 2016016519 | A1 | 2/2016 |
| WO | 2016059303 | A1 | 4/2016 |
| WO | 2016087724 | A1 | 6/2016 |
| WO | 2016087725 | A1 | 6/2016 |

OTHER PUBLICATIONS

International Written Opinion for International Application No. PCT/IB2016/001950 dated Jul. 20, 2017, 4 pages.

Wu et al, A Precise Drunk Driving Detection Using Weighted Kernel Based on Electrocardiogram, Sensors 2016, 16, 659. 9 pages.

* cited by examiner

SMARTWATCH ASSEMBLIES HAVING ANALOG DIALS WITH SPECIFIC FUNCTIONALITIES

CROSS-REFERENCE TO RELATED APPLICATIONS

This application is a continuation of U.S. patent application Ser. No. 15/393,903, filed Dec. 29, 2016, now U.S. Pat. No. 9,841,735, issued Dec. 12, 2017, which is a continuation-in-part of U.S. patent application Ser. No. 15/078,757, filed Mar. 23, 2016, now U.S. Pat. No. 9,671,757, issued Jun. 6, 2017, which is a continuation of U.S. patent application Ser. No. 14/983,262, filed Dec. 29, 2015, now U.S. Pat. No. 9,696,688, issued Jul. 4, 2017, the disclosure of each of which is hereby incorporated herein in its entirety by this reference. This application also claims the benefit of the filing date of U.S. Provisional Patent Application Ser. No. 62/420,452, which was filed Nov. 10, 2016, the disclosure of which is also incorporated herein in its entirety by this reference.

TECHNICAL FIELD

This disclosure relates generally to smartwatch assemblies and methods of making smartwatch assemblies. Specifically, this disclosure relates to smartwatch assemblies that have analog dials and that can alert users of events through LED modules and vibrations.

BACKGROUND

Smartwatches are wristwatches that have functionality beyond timekeeping. Some smartwatches are portable media players, and some smartwatches run mobile apps using a mobile operating system. Smartwatches often include electronic display screens where a user can interface with the smartwatches and control their functionality. However, by having an electronic display screen, the smartwatches lose a classic analog look and are often bulky in order to accommodate the circuitry needed to have an electronic display screen.

Although smaller than smartphones, smartwatches can often be intrusive and/or distracting because the electronic display screen fully lights up when a text or email is received. Furthermore, by having an electronic display screen, the smartwatches drain battery power quickly and require recharging on a regular basis.

BRIEF SUMMARY

Some embodiments of the present disclosure include a smartwatch assembly. The smartwatch assembly may include a watch casing having a dial portion and a circuit board disposed therein. The dial portion may include a plurality of hour-mark apertures extending therethrough. The circuit board may include a plurality of LED modules disposed thereon. The plurality of LED modules may be oriented to emit light toward the plurality of hour-mark apertures of the dial portion.

Some embodiments of the present disclosure include a smartwatch assembly. The smartwatch assembly may include a watch casing having a dial portion and a circuit board disposed therein. The dial portion may include a face plate, a plurality of hour-mark apertures extending through the face plate, and an hour hand extending from a center of the face plate and pointing, at least generally, toward one or more of the hour-mark apertures. The circuit board may include a board portion, a plurality of LED modules disposed on the board portion and oriented to emit light through the plurality of hour-mark apertures of the dial portion, a control module configured to illuminate at least one LED module of the plurality of LED modules in response to one or more alerts, and a communication module configured to interface with an electronic device wirelessly and to receive the one or more alerts.

Some embodiments of the present disclosure include a method of making a smartwatch assembly. The method may include disposing a dial portion having a face plate and a plurality of hour-mark apertures extending through the face plate in a watch casing and disposing a circuit board having a plurality of LED modules disposed thereon in a watch casing, the plurality of LED modules corresponding to the plurality of hour-mark apertures.

Some embodiments of the present disclosure include a smartwatch assembly. The smart watch assembly may include a watch body, a dial portion, a plurality of light sources, and a control module. The dial portion may be disposed within the watch body and may include a face plate having a plurality of hour-mark positions, an hour hand extending radially from a center of the face plate, and a minute hand extending radially from a center of the face plate. The plurality of light sources may be disposed within the watch body and may be positioned to correlate to the plurality of hour-mark positions of the face plate of the dial portion. The control module may be configured to illuminate one or more of the plurality of light sources. Furthermore, the control module may be configured to cause one or more of the plurality of light sources to emit a first color of light to indicate to a user a first notification from a smartphone in wireless communication with the smartwatch assembly and to cause one or more of the plurality of light sources to emit a second color of light to indicate to the user a second notification from the smartphone.

In yet further embodiments, the present disclosure includes a smartwatch assembly comprising a watch casing, a dial portion disposed in the watch casing and having a plurality of hour mark apertures extending therethrough, a circuit board disposed within the watch casing and including a processor and memory, and a plurality of LED modules oriented to emit light toward the plurality of hour mark apertures of the dial portion. The smartwatch assembly has both an analog clock including an hour hand and a minute hand and a digital clock. The smartwatch assembly is configured to indicate time data to a user by illumination of one or more of the plurality of LED modules through the plurality of hour mark apertures of the dial portion.

In additional embodiments, the present disclosure includes a smartwatch assembly comprising a watch casing and a dial portion disposed in the watch casing. The dial portion includes a face plate having a plurality of hour-mark apertures extending through the face plate at hour mark positions of an analog clock, an hour hand extending radially outwardly from a center of the face plate, and a minute hand extending radially outwardly from the center of the face plate. The smartwatch assembly further includes a circuit board disposed in the watch casing. The circuit board comprises a board portion, a plurality of LED modules disposed on the board portion and oriented to emit light through the plurality of hour-mark apertures of the dial portion, a control module configured to control illumination of the LED modules in such a manner as to convey alerts and/or time data information to a user, and a communication module configured to wirelessly interface with an operatively associated electronic device. At least some of the alerts and/or time data are received by the smartwatch assembly from the operatively associated electronic device.

BRIEF DESCRIPTION OF THE DRAWINGS

The patent or application file contains at least one drawing executed in color. Copies of this patent or patent application publication with color drawings will be provided by the Office upon request and payment of the necessary fee.

For a detailed understanding of the present disclosure, reference should be made to the following detailed description, taken in conjunction with the accompanying drawings, in which like elements have generally been designated with like numerals, and wherein.

DETAILED DESCRIPTION

The illustrations presented herein are not actual views of any particular smartwatch assembly, or any component thereof, but are merely idealized representations, which are employed to describe the present invention.

As used herein, any relational term, such as "first," "second," "adjacent," "front," "rear," etc., is used for clarity and convenience in understanding the disclosure and accompanying drawings, and does not connote or depend on any specific preference or order, except where the context clearly indicates otherwise. For example, these terms may refer to an orientation of elements of the smartwatch assembly when the smartwatch assembly is being worn by a user on the user's arm in a conventional manner for wearing watches.

Some embodiments of the present disclosure include a smartwatch assembly that includes a classic analog dial portion while having smart features. For example, the smartwatch assembly may be able to indicate to a user that the user's smartphone has received a text, email, voicemail, and/or phone call. Furthermore, the smartwatch assembly may be able to indicate to a user that the user's smartphone is sounding an alarm or attempting to remind the user of an appointment or task. The smartwatch assembly may indicate these alerts to a user by illuminating hour-mark positions of the dial portion of the smartwatch assembly with a plurality of LED modules. Furthermore, the smartwatch assembly may illuminate different patterns of the hour-mark positions to indicate different alerts to the user. For example, the smartwatch assembly may illuminate a first pattern of hour-mark positions to indicate that the user has received a text on his or her smartphone, and the smartwatch assembly may illuminate a second pattern of hour-mark positions to indicate that the user has received email on his or her smartphone.

Some embodiments of the present disclosure include a smartwatch assembly that tracks a user's activity. For example, the smartwatch assembly may track a user's walking, running, swimming, and/or sleeping. In some embodiments, the smartwatch assembly may interface with a software application (i.e., an "app") executed on an associated (e.g., a "paired") smartphone to track the user's activity. In other embodiments, the smartwatch assembly may include a plurality of sensors to track the user's activity.

Figure 1:
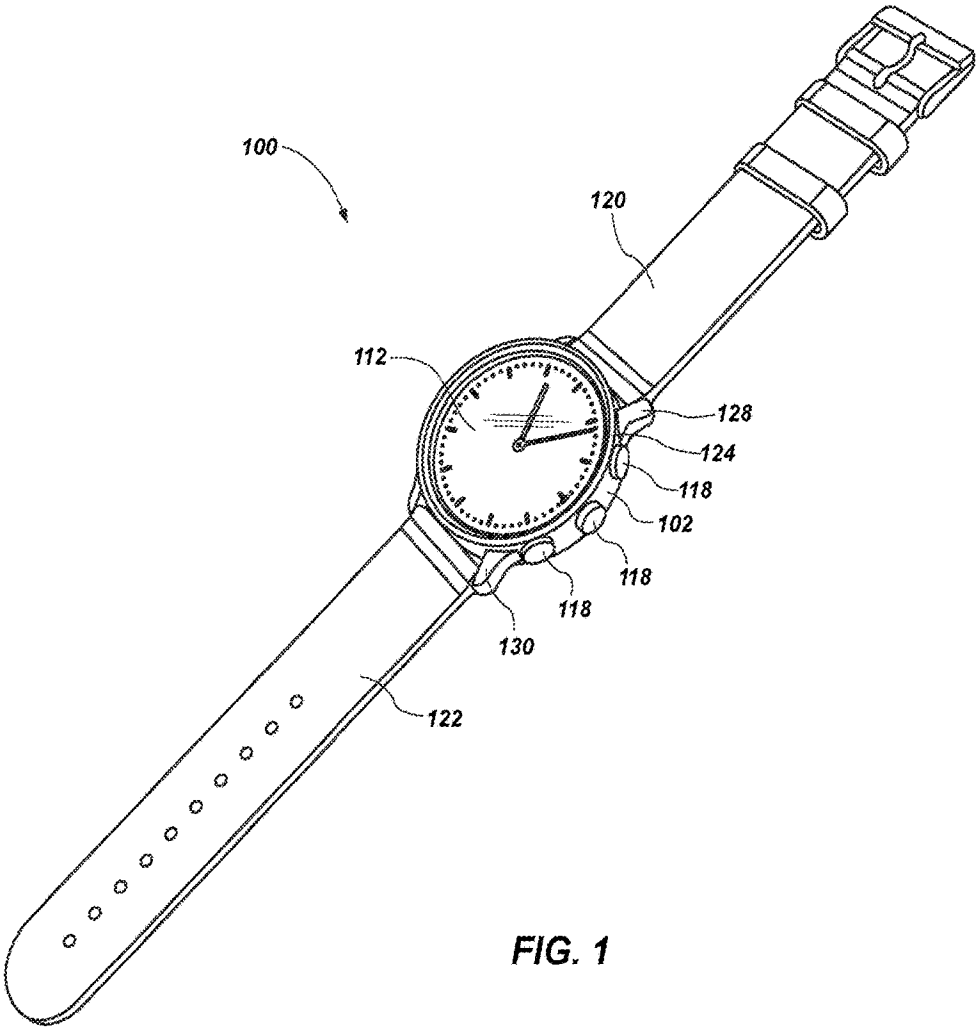
FIG. 1 is a perspective view of a smartwatch assembly according to an embodiment of the present disclosure.
Figure 2:
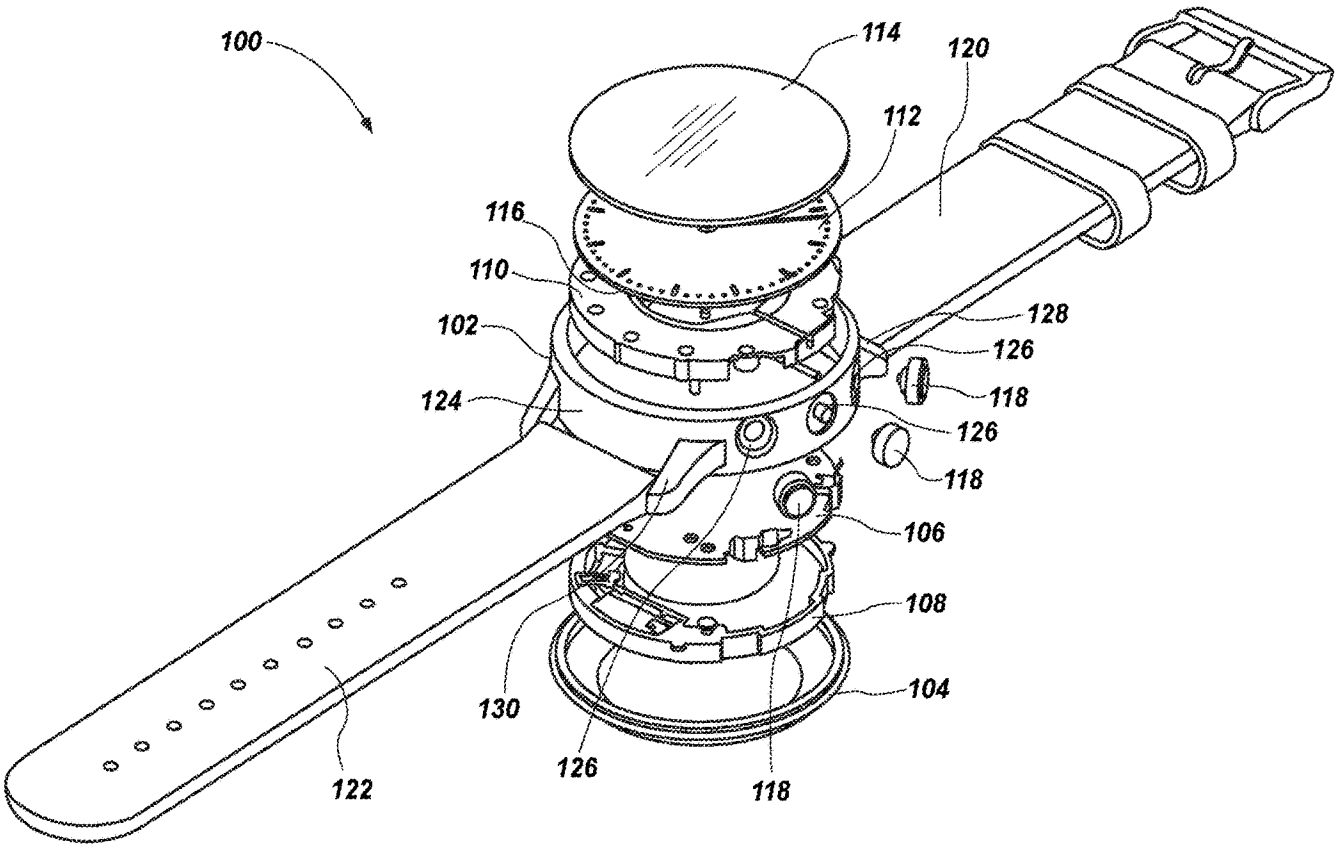
FIG. 2 is an exploded perspective view of the smartwatch assembly of FIG. 1.

FIG. 1 shows a perspective view of a smartwatch assembly 100 according to an embodiment of the present disclosure. FIG. 2 shows an exploded perspective view of the smartwatch assembly 100 of FIG. 1. Referring to FIGS. 1 and 2 together, the smartwatch assembly 100 may include a watch casing 102, a back cover 104, a printed circuit board assembly 106 ("PCBA 106"), a frame assembly 108, a light guide 110, a dial portion 112, a transparent portion 114, a light diffuser 116, a plurality of control mechanisms 118, a first strap 120, and a second strap 122.

The watch casing 102 may have a generally annular shape, and the PCBA 106, frame assembly 108, light guide 110, and dial portion 112 may be disposed within the watch casing 102. The back cover 104 may be removably coupled to a back side of the watch casing 102, and the transparent portion 114 may be attached to a front side of the watch casing 102, opposite the back side of the watch casing 102. As used herein, the phrase "back side" may refer to a side of the watch casing 102 that is intended to rest against the wrist of a user when the smartwatch assembly 100 is worn by the user, and the phrase "front side" may refer to a side of the watch casing 102 that is intended to face away from the wrist of the user when the smartwatch assembly 100 is worn by the user.

The frame assembly 108, PCBA 106, light guide 110, and dial portion 112 may be arranged within the watch casing 102 in a stacked formation (e.g., one on top of another). For example, the frame assembly 108 may be disposed adjacent to (e.g., next to) to the back cover 104. In other words, at least a portion of frame assembly 108 may be exposed when the back cover 104 is removed from the watch casing 102. The PCBA 106 may be disposed adjacent to (e.g., next to, on, over, etc.) the frame assembly 108 on a side of the frame assembly 108 opposite the back cover 104. In some embodiments, the PCBA 106 may be attached to the frame assembly 108 with at least one fastener (e.g., one or more screws). The light guide 110 may be disposed adjacent to (e.g., next to, on, over, etc.) the PCBA 106 and on a side of the PCBA 106 opposite the frame assembly 108. The dial portion 112 may be disposed adjacent to (e.g., next to, on, over, etc.) the light guide 110 and on a side of the light guide 110 opposite the PCBA 106.

As discussed above, the transparent portion 114 is attached to the front side of the watch casing 102. The transparent portion 114 (e.g., a glass cover) may allow a user to view the dial portion 112 of the smartwatch assembly 100 through the transparent portion 114. For example, the transparent portion 114 may include one or more of glass, sapphire glass, a polymer, crystal, and aluminosilicate glass.

In some embodiments, the watch casing 102 may include an annular side wall 124 and a plurality of holes 126 extending through the annular side wall 124 from an outer circumference of the watch casing 102 to an inner circumference of the watch casing 102. The plurality of control mechanisms 118 may be disposed in and extend through the plurality of holes 126 and may be operably coupled to the PCBA 106. In some embodiments, the plurality of control mechanisms 118 may include one or more of a button, a switch, and a crown.

In some embodiments, the watch casing 102 may include a first lug 128 and a second lug 130. The first and second lugs 128, 130 may extend out radially from the annular side wall 124 of the watch casing 102 on opposite sides of the watch casing 102. The first strap 120 may be coupled to the first lug 128, and the second strap 122 may be coupled to the second lug 130. The first and second straps 120, 122 may be sized and shaped to be wrapped around a wrist of a user and to fasten the smartwatch assembly 100 to the wrist of the user.

Figure 3:
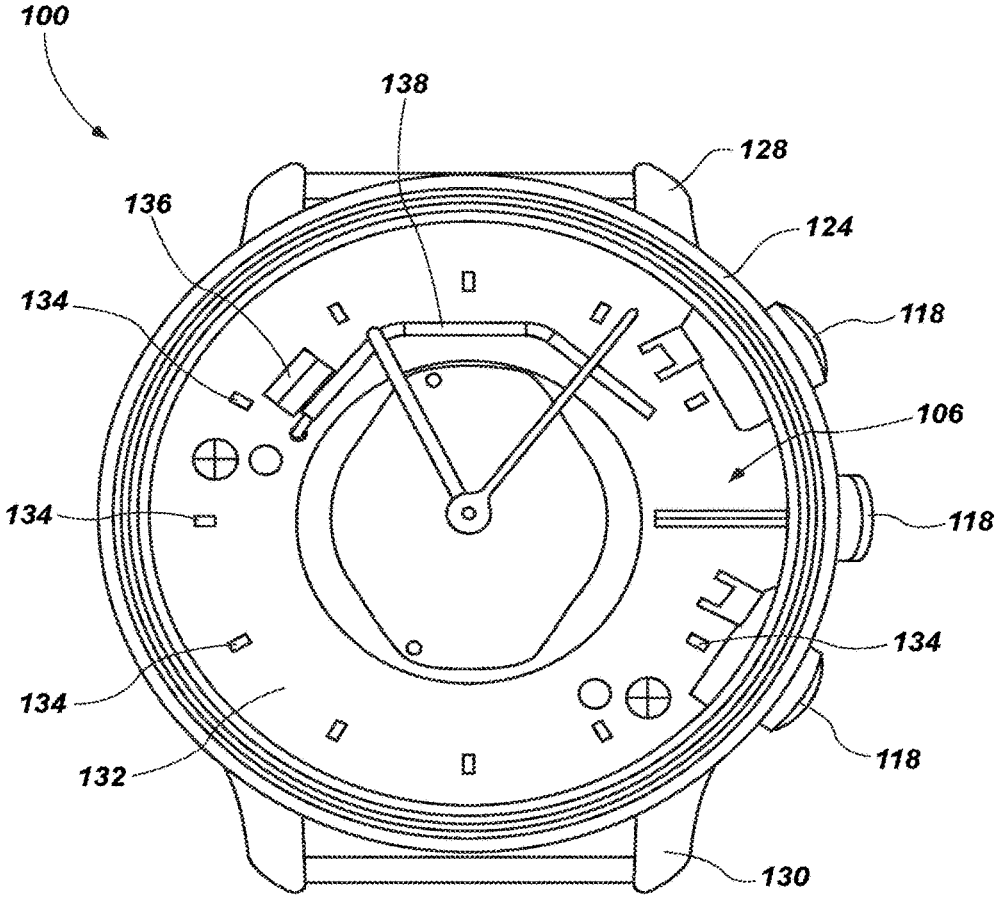
FIG. 3 is a front plan view of a smartwatch assembly showing a printed circuit board assembly of the smartwatch assembly according to an embodiment of the present disclosure.

FIG. 3 is a front side view of a smartwatch assembly 100 with the first and second straps 120, 122 and the dial portion 112 removed to show an internal structure of the smartwatch assembly 100 according to an embodiment of the present disclosure. The PCBA 106 of the smartwatch assembly 100 may include a printed circuit board portion 132, a plurality of light sources 134 (e.g., a plurality of LED modules 134), a control module 136, and a communication module 138. The plurality of LED modules 134 may be operably coupled to the control module 136, and the control module 136 may control when the plurality of LED modules 134 are illuminated. In some embodiments, the control module 136 may include a microcontroller (i.e., an MCU).

The plurality of LED modules 134 may include an LED module 134 disposed and located to correlate to (e.g., in alignment with) each hour-mark position of the dial portion 112 (e.g., each hour-mark position of a conventional watch or clock). For example, the plurality of LED modules 134 may include an LED module 134 at each of a 12 o'clock position, a 1 o'clock position, a 2 o'clock position, etc., of a conventional analog watch. In some embodiments, a 3 o'clock position may not include an LED module 134 due to positioning of the plurality of control mechanisms 118. In other embodiments, the plurality of LED modules 134 may include an LED module 134 at each hour-mark position.

Each LED module 134 of the plurality of LED modules 134 may include a white LED or white LED module and at least one colored LED or colored LED module. The at least one colored LED may include one or more of a blue LED, green LED, red LED, yellow LED, purple LED, and an orange LED. Although specific colors are listed, the at least one colored LED may include an LED of any color. For example, the at least one colored LED may include an LED of any color within the color spectrum. In some embodiments, a color of the at least one LED module may be altered by changing a voltage being applied to the at least one LED.

In other embodiments, any other suitable type of light source may be employed in place of the LED modules 134.

The communication module 138 may be operably coupled to the control module 136 and may enable the smartwatch assembly 100 to wirelessly communicate with other devices. For example, the communication module 138 may enable the smartwatch assembly 100 to communicate with other devices through Wi-Fi, BLUETOOTH® 2.0, BLUETOOTH® low energy ("BLE") 4.0, infrared communication, ANT, ANT+, etc. In some embodiments, the communication module 138 may enable the smartwatch assembly 100 to communicate with a smartphone, such as, for example, an IPHONE® or an ANDROID® phone. For example, the control module 136 may be able to communicate with devices using IOS® software and/or ANDROID® software. In some embodiments, an application (or "app") specific to the smartwatch assembly 100 may be installed on a smartphone (hereinafter "SW app") and may allow a user to customize features of the smartwatch assembly 100 from the smartphone. In some embodiments, the SW app and/or smartwatch assembly 100 may interface with, for example, the HEALTH KIT® App and/or the GOOGLE FIT® App or any other app designed to track a user's activity. As used herein, the term "activity" may refer to physical activity such as walking, running, swimming, burning calories, etc. Furthermore, the term "activity" may include other activities such as sleeping. In some embodiments, the smartwatch assembly 100 may communicate with and interface with other apps on a smartphone, such as, for example, mail apps, texting apps, call placing and receiving apps, sleep tracking apps, map apps, alarm apps, and global positioning apps. Moreover, the smartwatch assembly 100 may access data on the smartphone such as, for example, global positioning data, activity data, usage data, etc. In some embodiments, the smartwatch assembly 100 may be in at least substantially constant wireless communication with the smartphone. In some embodiments, the smartwatch assembly 100 may be able to stay in constant communication with the smartphone when the smartwatch assembly 100 is within approximately 50 meters of the smartphone. In some embodiments, the smartwatch assembly 100 may be able to stay in constant communication with the smartphone when the smartwatch assembly 100 is within approximately 100 meters of the smartphone. In some embodiments, the smartwatch assembly 100 may be able to stay in constant communication with the smartphone when the smartwatch assembly 100 is within approximately 150 meters of the smartphone.

Although the smartwatch assembly 100 is described herein as communicating with a smartphone, embodiments of the present disclosure may not be so limited. For example, the smartwatch assembly 100 may communicate and may interface with one or more of a computer, a laptop, a personal digital assistant, a pedometer, and other mobile devices such as a FITBIT®, JAWBONE®, and other smartwatches. To facilitate explanation of the smartwatch assembly 100, the smartwatch assembly 100 will be described herein as communicating and interfacing with a smartphone. However, it is understood that that smartwatch assembly 100 may communicate and interface with any of the above-listed devices.

In some embodiments, the control module 136 may cause one or more of the plurality of LED modules 134 to illuminate in response to one or more events identified or created by the smartphone (referred to herein as "alerts") or the smartwatch assembly 100. For example, the control module 136 may cause one or more of the plurality of LED modules 134 to illuminate when a text, phone call, email, and/or voicemail is received on the smartphone. Furthermore, in some embodiments, control module 136 may cause one or more of the plurality of LED modules 134 to illuminate in response to activity performed by the user and as measured (e.g., tracked) by the smartphone or smartwatch assembly 100. In other words, the smartwatch assembly 100 may track an activity performed by the user and may indicate tracked (e.g., measured, recorded, sensed, etc.) activity to the user by illuminating one or more of the plurality of LED modules 134. For example, the control module 136 may cause one or more of the plurality of LED modules 134 to illuminate to indicate to a user a quantity and/or quality of an activity (e.g., walking, running, swimming, calories burned, sleeping, etc.) performed by the user.

Figure 4:
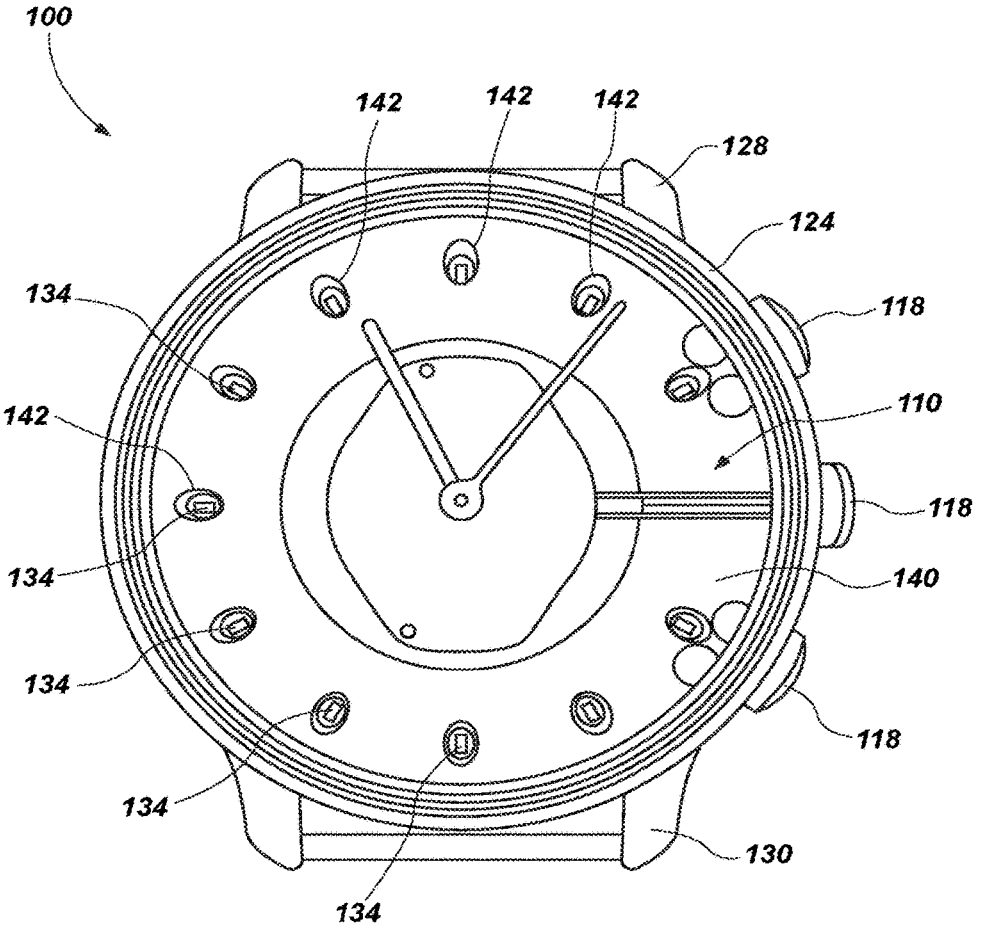
FIG. 4 is a front plan view of a smartwatch assembly showing a light guide assembly of the smartwatch assembly according to an embodiment of the present disclosure.

FIG. 4 is a front side view of a smartwatch assembly 100 showing the light guide 110 according to an embodiment of the present disclosure. Some portions of the smartwatch assembly 100 are removed to show the internal structure of the smartwatch assembly 100. Referring to FIGS. 3 and 4 together, as discussed above, the light guide 110 may be disposed adjacent to and proximate to the PCBA 106. The light guide 110 may include a plate portion 140 having a plurality of light guide holes 142 extending therethrough. In some embodiments, the plate portion 140 of the light guide 110 may have a generally annular shape and may extend over portions of the PCBA 106 having the plurality of LED modules 134. The plurality of light guide holes 142 may include a light guide hole 142 for each LED module 134 of the plurality of LED modules 134 of the PCBA 106. For example, the light guide 110 may be oriented relative to the PCBA 106 such that each LED module 134 of the plurality of LED modules 134 is positioned within (e.g., aligned with) a respective light guide hole 142 of the plurality of light guide holes 142, and light emitted by the plurality of LED modules 134 may pass through the plurality of light guide holes 142, respectively. Put another way, each light guide hole 142 of the plurality of light guide holes 142 may correspond to an hour-mark position of the dial portion 112 (FIG. 1) of the smartwatch assembly 100. The material of the light guide 110 may be at least substantially non-transparent (e.g., opaque) to the light emitted by the LED modules 134, such that the light emitted by the LED modules 134 is only able to pass through the light guide holes 142 and not through the material of the light guide 110. The plurality of light guide holes 142 may be sized and shaped to guide light emitted by the plurality of LED modules 134 toward the dial portion 112 (FIG. 1) of the smartwatch assembly 100. Furthermore, the plurality of light guide holes 142 may help to prevent light from being emitted in a wrong direction (e.g., away from the dial portion 112 (FIG. 1)). As a result, the light guide 110 may lead to more light being viewable by a user and may reduce an amount of power need to achieve a desired amount of light reaching the dial portion 112 of the smartwatch assembly 100.

Figure 5:
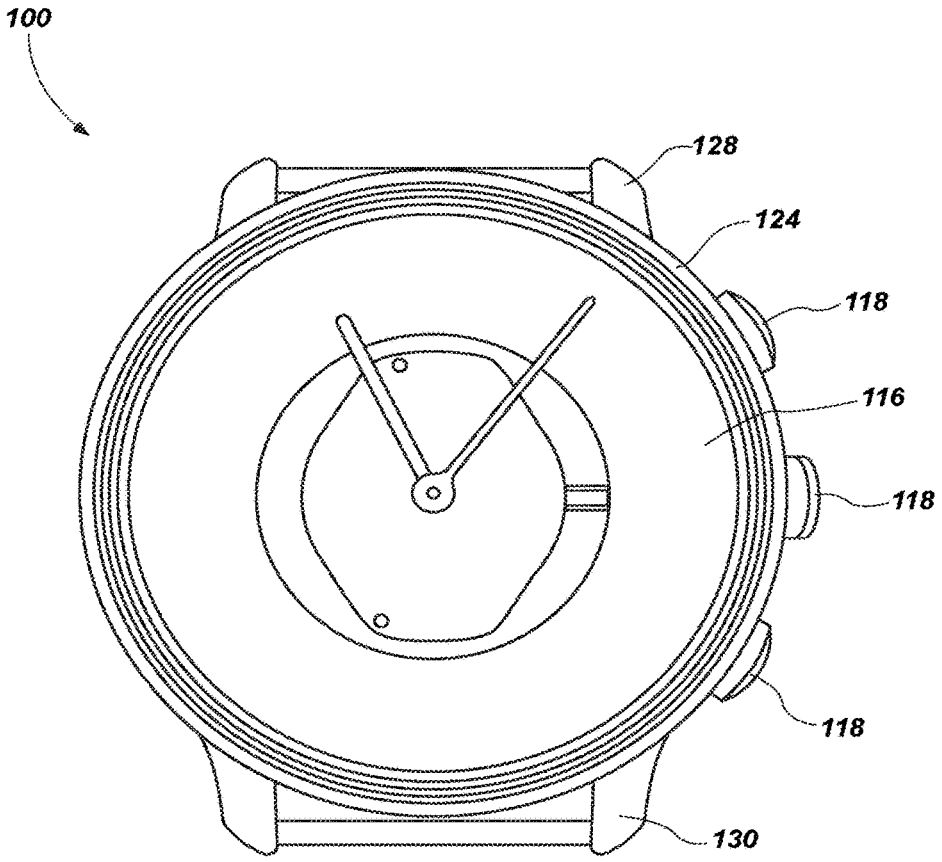
FIG. 5 is a front plan view of a smartwatch assembly showing a light diffuser of the smartwatch assembly according to an embodiment of the present disclosure.

FIG. 5 is a front side view of a smartwatch assembly 100 showing the light diffuser 116 according to an embodiment of the present disclosure. Some portions of the smartwatch assembly 100 are removed to show the internal structure of the smartwatch assembly 100. As discussed above, the light diffuser 116 may be disposed adjacent to the light guide 110 (FIG. 4) on a side of the light guide 110 (FIG. 4) opposite the PCBA 106 (FIG. 3). The light diffuser 116 may have a generally annular shape and, in some embodiments, may cover at least substantially all of light guide holes 142 (FIG. 4) of the light guide 110 (FIG. 4). In some embodiments, the light diffuser 116 may include a thin film of material. For example, the light diffuser 116 may include a MYLAR® film. In some embodiments, the light diffuser 116 may include one or more of a polyester film and a polyethylene terephthalate sheet.

Referring to FIGS. 1, 3, and 5 together, the light diffuser 116 may be translucent (e.g., semitransparent) so as to allow at least some light emitted by the plurality of LED modules 134 to pass therethrough. In some embodiments, the light diffuser 116 may diffuse (e.g., spread, scatter, distribute) light emitted by the plurality of LED modules 134 to provide an omni-directional emission of the light to a user on the dial portion 112 of the smartwatch assembly 100, emitting respectively from the locations of the light guide holes 142 in the light guide 110. For example, light emitted by the plurality of LED modules 134 may be at least substantially directional (e.g., may have a narrow viewing angle) and without the light diffuser 116, the light may not be readily viewable from at least some angles from which the smartwatch assembly 100 may typically be viewed. With the light diffuser 116, the light emitted by the plurality of LED modules 134 may be viewable from a wider range of angles. For example, the light diffuser 116 may enable light emitted by the plurality of LED modules 134 to be viewable within a viewing angle, as would be understood by one of ordinary skill in the art, of approximately 175°. In some embodiments, the smartwatch assembly 100 may not include a light diffuser 116 but may include LED modules 134 having wider viewing angles.

Figure 6:
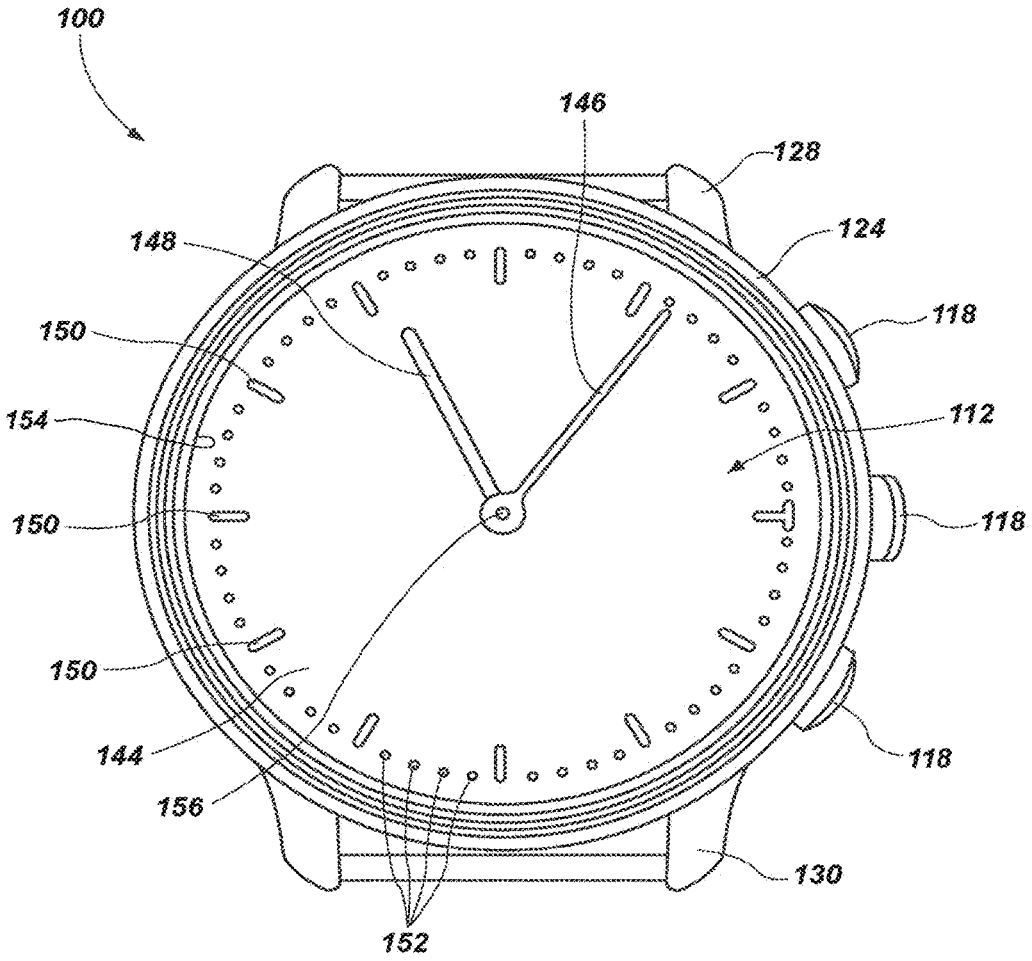
FIG. 6 is a front plan view of a smartwatch assembly showing a dial portion of the smartwatch assembly according to an embodiment of the present disclosure.

FIG. 6 is a front side view of a smartwatch assembly 100 showing a dial portion 112 of the smartwatch assembly 100 according to an embodiment of the present disclosure. Some portions of the smartwatch are removed to show the structure of the smartwatch assembly 100. The dial portion 112 of the smartwatch assembly 100 may include a face plate 144, a minute hand 146, an hour hand 148, a plurality of hour-mark apertures 150, and a plurality of minute-mark apertures 152. The plurality of hour-mark apertures 150 and the plurality of minute-mark apertures 152 may extend through the face plate 144. The plurality of hour-mark apertures 150 may be located proximate an outer peripheral edge 154 of the face plate 144, and each hour-mark aperture 150 of the plurality of hour-mark apertures 150 may correspond to an hour-mark position of the face plate 144 (e.g., hour-mark positions of a conventional clock face). The plurality of minute-mark apertures 152 may also be located proximate the outer peripheral edge 154 of the face plate 144, and each minute-mark aperture 152 of the plurality of minute-mark apertures 152 may correspond to a minute-mark position of the face plate 144 (e.g., minute positions of a conventional clock face). In some embodiments, the plurality of hour-mark apertures 150 may be larger in size than the plurality of minute-mark apertures 152.

The plurality of hour-mark apertures 150 and the plurality of minute-mark apertures 152 may enable light emitted by the plurality of LED modules 134 (FIG. 3) through the light guide 110 (FIG. 4) and light diffuser 116 (FIG. 5) to pass therethrough. As a result, the light emitted by the plurality of LED modules 134 may be viewable to a user through the dial portion 112 of the smartwatch assembly 100. Furthermore, the light emitted by the plurality of LED modules 134 may illuminate (e.g., lighten, brighten, irradiate) the plurality of hour-mark apertures 150 and the plurality of minute-mark apertures 152.

The minute hand 146 and hour hand 148 of the dial portion 112 may extend from a center 156 of the face plate 144 toward the plurality of hour-mark apertures 150 and the plurality of minute-mark apertures 152. For example, the smartwatch assembly 100 may include a conventional minute and hour hand 146, 148 of an analog watch. The minute hand 146 and the hour hand 148 may rotate about an axis extending through the face plate 144 and orthogonal to a face surface of the face plate 144.

The dial portion 112 of the smartwatch assembly 100 may not include an electronic display screen. In other words, the dial portion 112 may not include a graphical interface.

As discussed above, the glass portion of the smartwatch assembly 100 may be disposed above (e.g., spaced apart from) the dial portion 112, and the dial portion 112 may be viewable through the glass portion.

Figure 7:
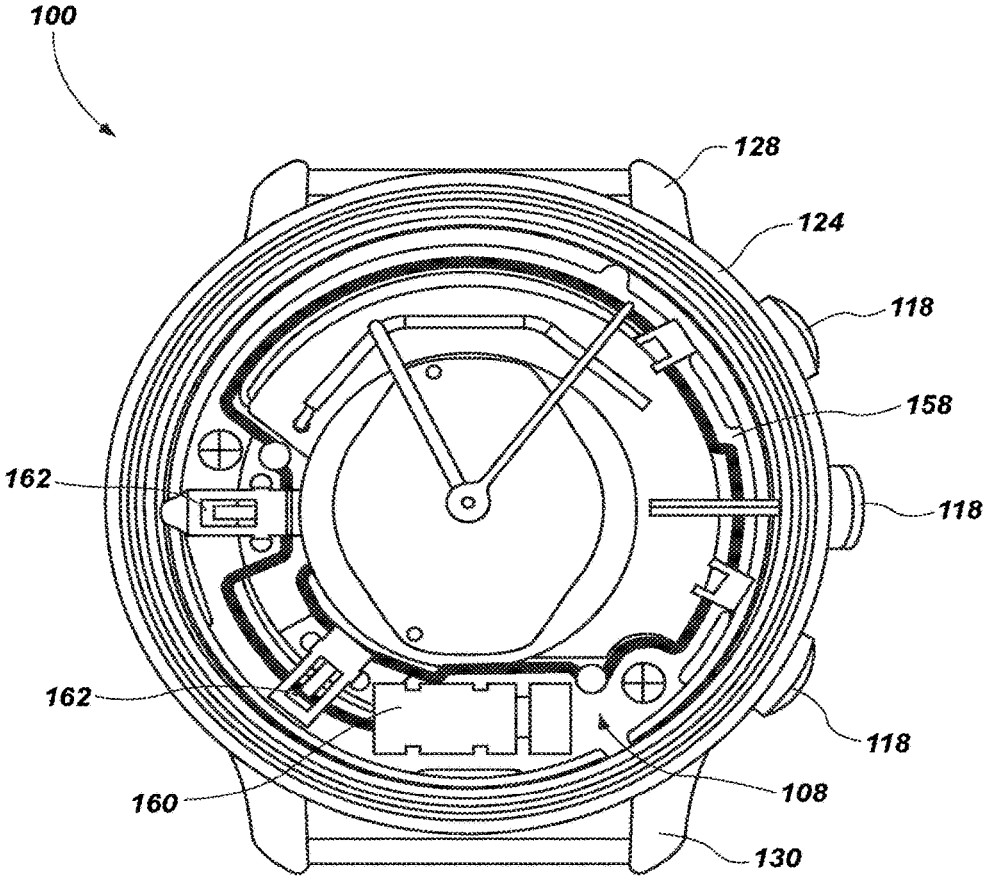
FIG. 7 is a front plan view of a smartwatch assembly showing a frame assembly of the smartwatch assembly according to an embodiment of the present disclosure.

FIG. 7 is a front side view of the smartwatch assembly 100 showing the frame assembly 108. Some portions of the smartwatch assembly 100 are removed to show the internal structure of the smartwatch assembly 100. The frame assembly 108 may include a frame structure 158, a vibrator 160, and a plurality of sensors 162.

The frame structure 158 may be sized and shaped to receive at least one battery. In some embodiments, the frame structure 158 may be sized and shaped to receive at least two batteries. In such embodiments, the frame structure 158 may be sized and shaped to receive a first battery to power smart features (e.g., powering the control module 136, communication module 138, and plurality of LED modules 134) of the smartwatch assembly 100 and a second battery to power timekeeping features.

The vibrator 160 may be mounted to the frame assembly 108 and may include a conventional motor that spins an off-center weight to cause vibrations. The vibrator 160 may be operably coupled to the control module 136 (FIG. 3) and may be used (e.g., caused to vibrate) in response to certain events, such as, an alarm of the smartphone and the smartphone receiving a text, email, voicemail, and/or phone call. The plurality of sensors 162 may be operably coupled to the control module 136 (FIG. 3) and may include one or more of a magnetic pendulum (i.e., pedometer) and a sleep monitor. For example, the plurality of sensors 162 may include at least one multi-axis accelerometer. In some embodiments, the accelerometer may include at least 3 axes. In some embodiments, the accelerometer may include at least 6 axes. The plurality of sensors 162 may provide information to the control module 136 (FIG. 3) to track activity of a user.

In some embodiments, the sensors 162 may include sensors that are configured to measure one or more of the user's heart rate and oxygen saturation ($SO_2$). Additionally or alternatively, the sensors 162 may include an electrocardiogram sensor (ECG). Such a sensor 162 may be configured so as to be in contact with the user's skin while wearing the smartwatch assembly 100. In such embodiments, the sensor 162 may be exposed through the back cover 104 of the smartwatch assembly 100, for example. In other embodiments, such a sensor 162 may be located and configured to allow the user to touch the sensor 162 with the user's off hand, which is not wearing the watch. In such embodiments, the sensor 162 may be exposed through the lateral side of the watch casing 102 or through the front surface of the smartwatch assembly 100.

In embodiments in which the smartwatch assembly 100 includes an ECG sensor, the ECG sensory may be configured to obtain an electrocardiogram measurement from the user, including the parameters pertaining to the "QRS complex" of the acquired electrocardiogram data. The smartwatch assembly 100 may include algorithms stored in memory, which may be executed by a processor using the acquired electrocardiogram data to provide information to the user pertaining to one or more of the following variables: heart rate, effective heart age (as opposed to actual heart age), heart rate robustness, heart rate variability, quality of the electrocardiogram signal, parameters of the QRS complex, mood, fatigue, and stress.

The LED modules 134 may be used to provide feedback to the user while the user is attempting to use the ECG sensor. For example, one or more of the LED modules 134 may be illuminated with a first color (e.g., red) to alert the user that the ECG sensor could not acquire an ECG signal, one or more of the LED modules 134 may be illuminated with a second color (e.g., amber) to alert the user that the ECG sensor is actively acquiring an ECG signal, and one or more of the LED modules 134 may be illuminated with a third color (e.g., green) to alert the user that the ECG sensor has completed acquisition of the ECG signal. The vibrator 160 may also vibrate upon completion of the acquisition of the ECG signal. The LED modules 134 may also be used to provide information to the user pertaining to the variables listed above as calculated using the algorithms and the acquired ECG signal. The data may be transmitted to the smartphone or other associated device for further viewing, review, and tracking by the user.

In some embodiments, the ECG signal may also be able to detect that the user is possibly intoxicated (e.g., by alcohol, medications, etc.). For example, algorithms have been disclosed for estimating intoxication using ECG data. See, for example, C. K. Wu et al., *A Precise Drunk Driving Detection Using Weighted Kernel Based On Electrocardiogram*, Sensors 2016, 16, 659, the contents of which are incorporated herein in their entirety by this reference. In such an embodiment, the smartwatch assembly 100 could use motion sensors to detect that the user is potentially driving a vehicle, and then perform an ECG to determine whether or not the user is potentially intoxicated. If the smartwatch assembly 100 detects that the user is potentially intoxicated, the smartwatch assembly 100 may alert the user by using the LED modules 134.

In embodiments in which the smartwatch assembly 100 includes an ECG sensor, user's who are known to be prone to heart irregularities or who are at risk for a heart attack, may place the smartwatch assembly 100 into an operational mode in which the ECG periodically acquires ECG signals from the user and analyzes the acquired signals for heart irregularities. In the event an irregularity is detected, the smartwatch assembly 100 may alert the user using the LED modules 134 and/or the vibrator 160.

Figure 8:
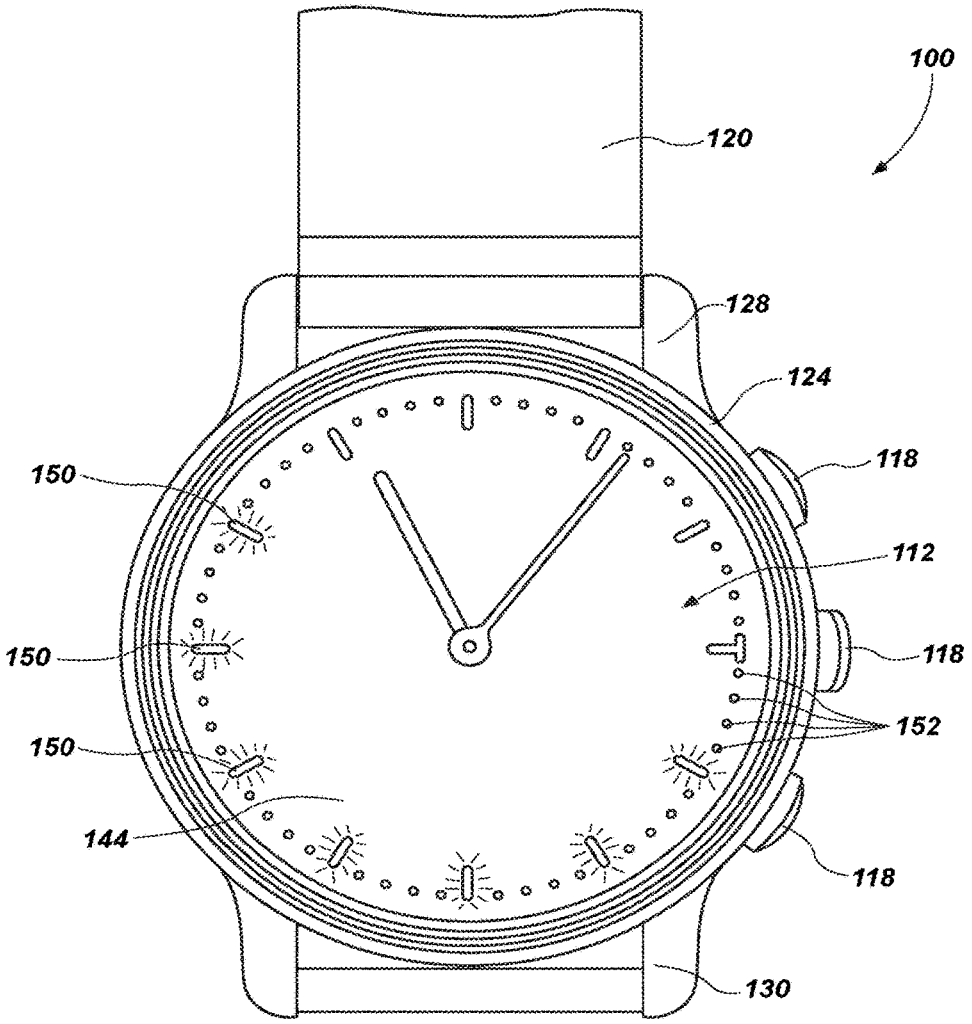
FIG. 8 is a front plan view of a smartwatch assembly showing a dial portion of the smartwatch assembly having a plurality of LED modules illuminated according to an embodiment of the present disclosure.

FIG. 8 is a partial front side of the smartwatch assembly 100 showing the dial portion 112 with a number of the plurality of LED modules 134 (FIG. 3) illuminated. Referring to FIGS. 3 and 8 together, as discussed above, in some embodiments, the smartwatch assembly 100 may track activity of a user. For example, the smartwatch assembly 100 may track one or more of steps taken, running distance, calories burned, swimming strokes, and sleep time and quality of sleep.

As discussed above, the smartwatch assembly 100 may interface with a smartphone via wireless communication, and the functionality of the smartwatch assembly 100 may be customizable via the SW app on the smartphone. For example, via the SW app, a user may cause the smartwatch assembly 100 to track one or more of steps taken, running distance, calories burned, swimming strokes, sleep time, and quality of sleep. Furthermore, the user may set goals in one or more of the above categories.

The smartwatch assembly 100 may indicate to a user measurements and/or progression of a chosen activity during a period of time (e.g., a day) by illuminating a portion of the plurality of LED modules 134, which may, in turn, illuminate portions of the face plate 144 of the dial portion 112 of the smartwatch assembly 100. As a non-limiting example, a user may set a goal of steps to take for day, and the smartwatch may track the user's progress on achieving the goal.

In some embodiments, each hour segment of the face plate 144 of the dial portion 112 may represent a percentage of the goal. For example, a goal may be divided by twelve and each hour segment may represent about 8.33% of a goal. For example, with a goal of 10,000 steps, each hour segment of the face plate 144 of the dial portion 112 may represent 833 steps. As a result, once a user has taken 833 steps during a given period of time (e.g., a day), an hour segment of the face plate 144 of the dial portion 112 may be illuminated, and after each subsequent set of 833 steps taken by the user, an additional hour segment will illuminate. In some embodiments, each subsequent hour segment that is illuminated may be an hour segment that is immediately adjacent a previously illuminated segment in a clockwise direction. In other words, as the hour segments are illuminated, the hour segments may be illuminated in a clockwise order.

In some embodiments, the first hour segment to illuminate to show progress of a goal may be the 4 o'clock hour since, in some embodiments, the 3 o'clock position of the smartwatch assembly 100 may not include an LED module 134. The second hour segment to illuminate to show progress of the goal may be the 5 o'clock hour, and any subsequent hour segments to illuminate may continue to be illuminated in a clockwise order. When all of the hour segments of the face plate 144 are illuminated, the user's goal has been completed. In other embodiments, the first hour segment to illuminate to show progress of a goal may be any hour-mark position.

In some embodiments, each hour segment may not represent a percentage of a goal. Rather, a user may set the smartwatch assembly 100 to have each hour segment represent a certain amount of steps. For example, a user may set the smartwatch assembly 100 to have each hour segment represent 500 steps, and after the user has taken 500 steps, an hour segment may be illuminated.

In some embodiments, the plurality of LED modules 134 may remain illuminated after being illuminated while tracking a user's activity. In other embodiments, the plurality of LED modules 134 will illuminate after the user achieves a milestone (e.g., a percentage of a goal and/or a set amount) for a brief period of time (e.g., 2 to 30 seconds) and then will extinguish. In such embodiments, a user may check his or her progress by engaging one or more of the control mechanisms 118. For example, the user may push one of the control mechanisms 118, which may cause the portion of the plurality of LED modules 134 indicating the percentage of the goal achieved and/or a total amount of activity achieved to illuminate. In some embodiments, the user may set illumination patterns of the smartwatch assembly 100 via the SW app on a smartphone.

In some embodiments, activity tracked by the smartwatch assembly 100 may be indicated with the white LED modules 134 of the plurality of LED modules 134. In other embodiments, activity tracked by the smartwatch assembly 100 may be indicated with colored LED modules 134. In some embodiments, activity tracked by the smartwatch assembly 100 may be indicated with both of the white LED modules 134 and the colored LED modules 134 of the plurality of LED modules 134.

In the non-limiting example of tracking running distance, the user may customize the smartwatch assembly 100 via the SW app on a smartphone. The user may set the smartwatch to have each hour segment indicate a percentage of a goal or a set distance. For example, the user may set a goal of five miles and have each hour segment indicate a percentage of the five-mile goal. As another example, the user may set the smartwatch assembly 100 to have each hour segment indicate one mile.

In the non-limiting example of tracking calories burned, the user may set the smartwatch assembly 100 to have each hour segment indicate a percentage of a goal or a set number of calories. For example, the user may set a goal of 400 calories and have each hour segment indicate a percentage of the 400-calorie goal. As another example, the user may set the smartwatch assembly 100 to have each hour segment indicate 50 calories.

In the non-limiting example of tracking swimming strokes, the user may set the smartwatch assembly 100 to have each hour segment indicate a percentage of a goal or a set number of strokes. For example, the user may set a goal of burning 400 strokes and have each hour segment indicate a percentage of the 400-stroke goal. As another example, the user may set the smartwatch assembly 100 to have each hour segment indicate 50 strokes.

In the non-limiting example of tracking sleep time, the user may set the smartwatch assembly 100 to have each hour segment indicate a percentage of a set amount of time. For example, the user may set the smartwatch to track sleep during a set amount of time and to indicate hour much of that time the user spent sleeping. As a result, each hour segment may be set to indicate a percentage of the set amount of time or a set amount of time of sleep.

In the non-limiting example of tracking sleep quality, the user may set the smartwatch assembly 100 to have each hour segment indicate a counter for indicating a quality of sleep. In other words, the more hour segments that are illuminated, the higher quality of sleep the user has experienced. For example, when tracking sleep quality and when a user has had a high quality of sleep, the smartwatch assembly 100, after tracking the sleep, may illuminate seven to ten LED modules 134 (i.e., seven to ten hour segments). Additionally, when a user has had a medium quality of sleep, the smartwatch assembly 100 may illuminate four to six LED modules 134 (i.e., four to six hour segments). Moreover, when a user has had a low quality of sleep, the smartwatch assembly 100 may illuminate zero to three LED modules 134 (i.e., zero to three hour segments). The quality of sleep of a user may be tracked with the plurality of sensors 162 (FIG. 7) (e.g., the multi-axis accelerometer) by tracking movement of the user during a specified period of time. For example, less movement of the user may indicate a higher quality of sleep while more movement of the user may indicate a lower quality of sleep.

In some embodiments, different colors of the LED modules 134 may be used to indicate different qualities of sleep. As a non-limiting example, three blue-colored LED modules 134 may be illuminated to indicate to the user that the user had three hours of high quality of sleep, and three additional red-colored LED modules 134 may be illuminated to indicate to the user that the user had three hours of medium quality sleep.

In some embodiments, the smartwatch assembly 100 may use only a portion of the face plate 144 of the dial portion 112 to indicate activity tracked by the smartwatch assembly 100 to a user. For example, the smartwatch assembly 100 may use only the hour segments from the 3 o'clock position to the 9 o'clock position to indicate activity tracked by the smartwatch assembly 100 to a user.

In some embodiments, the smartwatch assembly 100 may acquire data required to track a user's activity from the plurality of sensors 162 (FIG. 7) included in the frame assembly 108 of the smartwatch assembly 100. In some embodiments, the smartwatch assembly 100 may acquire data required to track a user's activity from a smartphone. For example, the SW app may interface with other apps (e.g., HEALTH KIT® and GOOGLE FIT®) and functions (e.g., global positioning) of the smartphone to acquire data required to track a user's activity. In other words, in some embodiments, the SW app may track an activity with the smartphone and the smartwatch assembly 100 may indicate the activity tracked by the SW app on the smartphone. In some embodiments, the smartwatch assembly 100 may acquire data required to track a user's activity from both of the plurality of sensors 162 (FIG. 7) and a smartphone.

Figure 9:
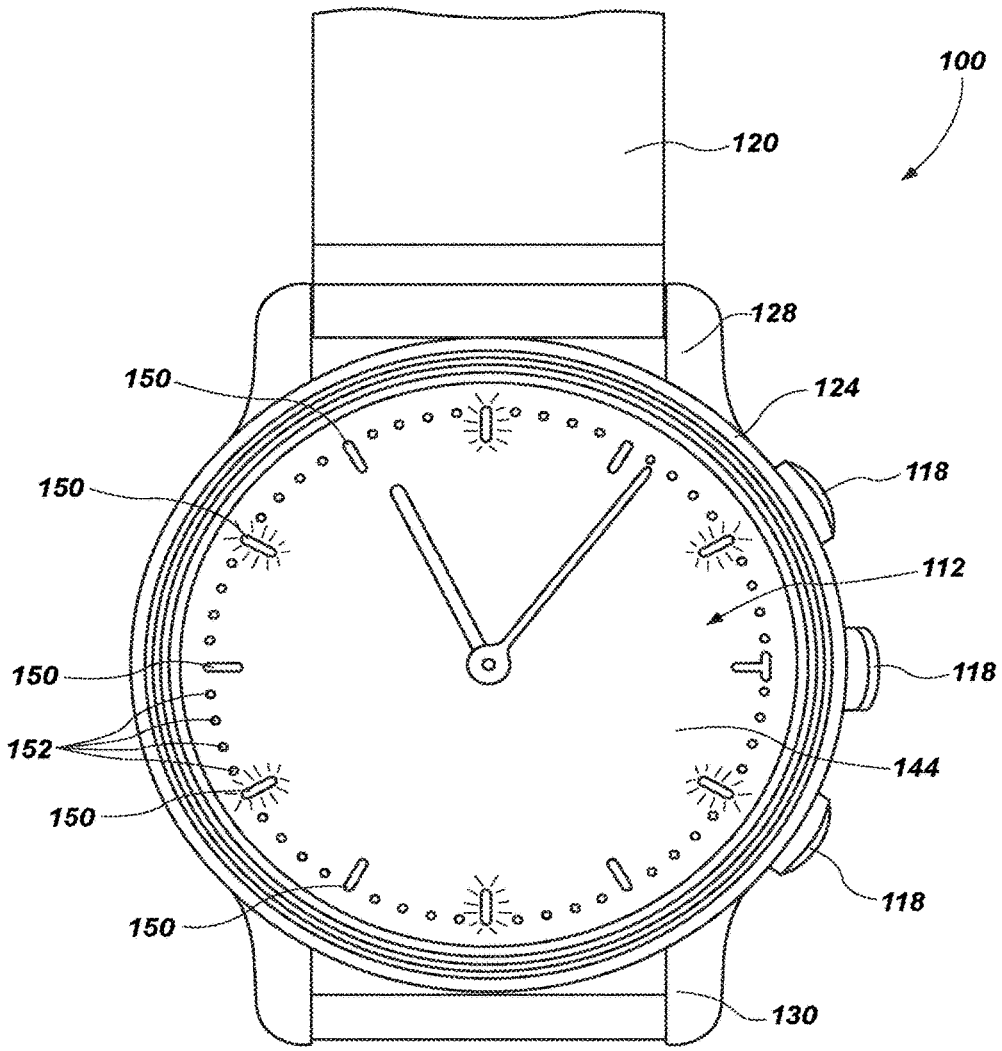
FIG. 9 is a front plan view of a smartwatch assembly showing a dial portion of the smartwatch assembly having a plurality of LED modules illuminated according to an embodiment of the present disclosure.

FIG. 9 is a partial front side of the smartwatch assembly 100 showing the dial portion 112 with a number of the plurality of LED modules 134 (FIG. 3) illuminated according to an embodiment of the present disclosure. Referring to FIGS. 3 and 9 together, as discussed above, in some embodiments, the one or more of the plurality of LED modules 134 may illuminate in response the user receiving an email, voicemail, phone call, and/or text on a smartphone. As discussed above, the smartwatch assembly 100 may be in wireless communication with a smartphone and the SW app may communicate with the smartwatch assembly 100 when an email, voicemail, phone call, and/or text is received on the smartphone. Furthermore, the SW app may communicate with the smartwatch assembly 100 to indicate reminders, appointments, alarms, tasks, etc. To facilitate description of the smartwatch assembly 100, each of the above-listed events will be described as an alert.

Referring to FIGS. 3, 4, and 9 together, in some embodiments, the control module 136 may cause one or more of the plurality of LED modules 134 to illuminate in different patterns to indicate what type of alert is being communicated by the smartphone. As a non-limiting example, the control module 136 may cause every other LED module 134 of the plurality of LED modules 134 to illuminate in response to a first type of alert. As another non-limiting example, control module 136 may cause the LED modules 134 of the plurality of LED modules 134 at the 2 o'clock, 4 o'clock, 8 o'clock, and 10 o'clock positions to illuminate in response to a second type of alert. Although specific patterns are described herein, as will be understood by one of ordinary skill in the art, any pattern could be used to indicate any of the above-listed alerts. Furthermore, how the smartwatch assembly 100 indicates an alert may be customizable by a user via the SW app. For example, the user may choose a pattern to be illuminated to indicate each type of alert.

Furthermore, in some embodiments, the above-listed alerts may be indicated and differentiated by different colored LED modules 134. For example, emails may be indicated with blue light, texts may be indicated with green lights, phone calls may be indicated with red lights, voicemails may be indicated with yellow lights, etc. A user may set which colors indicate which alerts with the SW app on the smartphone.

In some embodiments, in response to receiving an alert (e.g., email, text, voicemail, phone call, appointment, reminder, and alarm), the control module 136 may cause one or more of the plurality of LED modules 134 to be illuminated and the vibrator 160 (FIG. 7) to vibrate simultaneously. For example, an alert may be indicated by a combination of a pattern of LED modules 134 being illuminated and the vibrator 160 (FIG. 7) vibrating. Again, a user may be able to set how each alert is indicated using the SW app on a smartphone.

Having the smartwatch assembly 100 indicate alerts via the plurality of LED modules 134 and/or the vibrator 160 (FIG. 7) instead of an electronic display screen enables the smartwatch assembly 100 to maintain a classic analog appearance while providing smart features (e.g., activity tracking and providing alerts to a user). As a result, the smartwatch assembly 100 of the present disclosure may provide a more aesthetically pleasing appearance in comparison to other smartwatches. Moreover, because the smartwatch assembly 100 does not include an electronic display screen, the smartwatch assembly 100 may be smaller in size and may weigh less than other known smartwatches. Furthermore, because the smartwatch assembly 100 indicate alerts via plurality of LED modules 134 and/or the vibrator 160 (FIG. 7) instead of lighting up an electronic display screen or sounding a ringer, the smartwatch assembly 100 may be a less intrusive way for a user to stay aware of alerts during, for example, meetings, film showings, classes, or any other setting where ringing and/or constant buzzing of a smartphone may be inappropriate. Additionally, because the smartwatch assembly 100 differentiates to a user which type of an alert is being indicated, a user may more effectively filter which types of alerts the user may want inspect on his or her smartphone. For example, a user may be expecting a phone call and may be able to filter out other alerts without revealing or accessing his or her phone during a meeting.

As another non-limiting example, the smartwatch assembly 100 may provide a more effective way to keep a user apprised of alerts during exercise. For example, instead of having remove a user's smartphone from his or her pocket or remove it from an armband during exercise to view what alert is being indicated by a smartphone, a user can simply glance at his or her watch and know what alert is being indicated.

Moreover, because the smartwatch assembly 100 is worn on a wrist of a user and is likely to be in constant contact with the skin of a user, with the vibrator 160 and plurality of LED modules 134, the smartwatch assembly 100 may provide a more effective way to alert a user of an alert than a conventional smartphone, which is typically carried in a pocket of the user and may not be noticed when vibrating, ringing, or lighting up.

Referring to FIGS. 7-9 together, because the smartwatch assembly 100 does not have an electronic display screen, the smartwatch assembly 100 may require significantly less energy to power the smartwatch assembly 100 in comparison to other known smartwatches. As a result, the smartwatch assembly 100 may be powered by two conventional batteries. For example, the smartwatch assembly 100 may be powered by a first cell (e.g., a CR2025 cell) for smart features of the smartwatch assembly 100 and a second cell (e.g., a 364 cell) for timekeeping features of the smartwatch assembly 100. In some embodiments, the first cell may be able to provide sufficient power to the smartwatch assembly 100 for the smart features of the smartwatch assembly 100 to function for a period of at least about six months. Furthermore, the second cell may be able to provide sufficient power to the smartwatch assembly 100 for the timekeeping features of the smartwatch assembly 100 to function for a period of at least about five years. As a result, the smartwatch assembly 100 may not require any battery charging. In other words, the smartwatch assembly 100 may not include a permanent rechargeable battery.

By not requiring battery charging, the smartwatch assembly 100 may provide advantages over other known smartwatches. For example, conventional smartwatches having electronic display screens often require battery charging every three to four days, and even daily in some devices. Having to frequently charge the battery can become annoying and frustrating to a user. Furthermore, if a user forgets to charge the battery, the smartwatch becomes useless in both smart features and timekeeping features. Accordingly, by not requiring battery charging, the smartwatch assembly 100 of the current disclosure is more useful in settings where a user cannot charge a battery (e.g., traveling where power is not available) or does not want to have to worry about charging a battery of the smartwatch every few days.

In some embodiments, the smartwatch assembly 100 may be at least partially solar powered. For example, the face plate 144 of the dial portion 112 of the smartwatch assembly 100 and/or the transparent portion 114 (i.e., front cover) may include solar cells. In some embodiments, the solar cells may power one or more of the smart features and timekeeping features of the smartwatch assembly 100. As a non-limiting example embodiment, the dial portion 112 of the smartwatch assembly 100 and/or the transparent portion 114 (i.e., front cover) may include a photovoltaic solar cell material layer that is generally transparent, such as that commercially available from Sunpartner Technologies of Rousset, France, under the tradename WYSIPS®.

Figure 10:
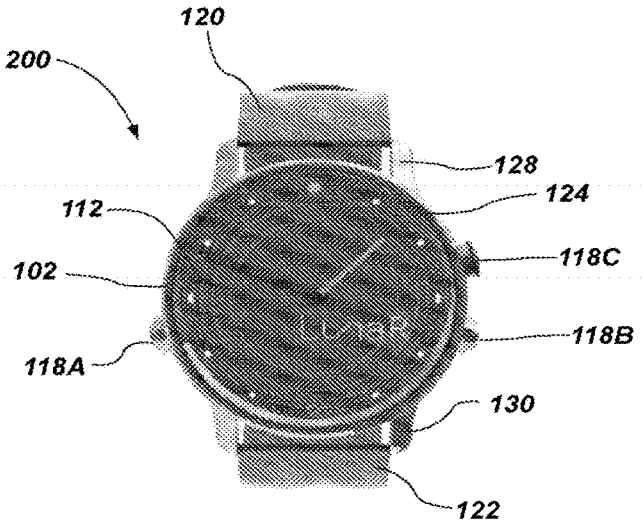
FIG. 10 is a front view of a smartwatch assembly according to another embodiment of the present disclosure.

FIG. 10 shows a perspective view of a smartwatch assembly 200 according to another embodiment of the present disclosure. The smartwatch assembly 200 is generally similar to the smartwatch assembly 100 described with reference to FIGS. 1 through 9, and includes a watch casing 102, a back cover 104, a PCBA 106, a frame assembly 108, a light guide 110, a dial portion 112, a transparent portion 114, a light diffuser 116, a plurality of control mechanisms 118, a first strap 120, and a second strap 122, as previously described. Furthermore, the PCBA 106 of the smartwatch assembly 200 includes a printed circuit board portion 132 having a plurality of light sources 134 (e.g., a plurality of LED modules 134). The PCBA 106 of the smartwatch assembly 200 includes a light source 134 as described herein at each of the hour positions, including at the 3 o'clock position.

The smartwatch assembly 200, however, includes a first button control mechanism 118A on the left, lateral side of the smartwatch assembly 200 at a location between the 8 o'clock and 9 o'clock positions, a second button control mechanism 118B on the right, lateral side of the smartwatch assembly 200 at a location between the 3 o'clock and 4 o'clock positions, and a crown control mechanism 118C on the right, lateral side of the smartwatch assembly 200 at a location between the 2 o'clock and 3 o'clock positions.

The crown control mechanism 118C may be used to set the time of the watch in the same manner as a conventional watch.

As previously discussed herein, the PCBA 106 of the smartwatch assembly 200 may include a printed circuit board portion 132, the plurality of light sources 134 (e.g., a plurality of LED modules 134), a control module 136, and a communication module 138. The control module 136 may include a microcontroller (i.e., an MCU). The communication module 138 may enable the smartwatch assembly 100 to communicate with other devices through, for example, a BLUETOOTH® communication protocol.

The BLUETOOTH® may be turned on by pressing or long pressing either the first button control mechanism 118A or the second button control mechanism 118B. Table 1 below illustrates the additional functions that may be carried out by the smartwatch assembly 200 depending on whether the first button control mechanism 118A or the second button control mechanism 118B is pressed once for a short time (e.g., less than two seconds), referred to as a "press," pressed twice successively, each for a short time, referred to as a "double press," or pressed once for a long period of time (e.g., two seconds or more), referred to as a "long press."

TABLE 1

| Button | Press | Double Press | Long Press |
|---|---|---|---|
| 118A | Check Progress of User's Activity | Find My Phone | Turn BLUETOOTH ® Off |
| 118B | Check the Local Time of the Watch | Check the Time of Sunrise and Sunset | Start/Stop Inactivity Tracking |

Of course, the functions set forth in Table 1 above and any other functions of the smartwatch 200 as described herein could be assigned to any of the control mechanisms 118A, 118B, and any other method or methods of initiating the functions using the control mechanisms 118A, 118B could be employed as well.

Table 2 below illustrates a non-limiting example of the colors of the LED modules 134 at each of the hour positions.

TABLE 2

| Position | Color of LED Module 134 |
|---|---|
| 12 o'clock | RGB |
| 1 o'clock | White |
| 2 o'clock | White |
| 3 o'clock | White |
| 4 o'clock | White |
| 5 o'clock | White |
| 6 o'clock | White |
| 7 o'clock | White |
| 8 o'clock | White |
| 9 o'clock | White |
| 10 o'clock | White |
| 11 o'clock | White |

In other embodiments, all of the LED modules 134 may be white LED modules 134, all of the LED modules 134 may be RGB LED modules 134, or any combination of the LED modules 134 may be RGB LED modules 134 with the remainder being white LED modules 134.

The smartwatch assembly 200 may have two operational modes. The first mode is a normal mode in which the watch functions normally as described herein. In this mode, the smartwatch assembly 200 tracks the activity of the user, the sleep of the user, it has a built in alarm, built in time for different time zones, and sunset and sunrise time and notifications as described herein. The second mode is a shipping mode in which the smartwatch assembly 200 "sleeps" and does nothing so as to conserve battery life. The smartwatch assembly 200 may be placed in shipping mode by pressing and holding the first button control mechanism 118A and the second button control mechanism 118B simultaneously until all white LED modules 134 blink and the RGB LED module 134 blinks red. The user may exit the shipping mode by long pressing the second button control mechanism 118B until all white LED modules 134 blink and the RGB LED module 134 blinks green. The BLUETOOTH® functionality may also be activated upon exiting the shipping mode.

In addition to the analog clock, the smartwatch assembly 200 also includes a digital clock. The digital time or approximate digital time of the watch may be indicated to the user using the LED modules 134 when the user presses the second button control mechanism 118B as indicated in Table 1 above. The hour may be shown by a white LED module 134, which may be illuminated continuously for a period of time, such as two seconds. The minutes may be shown by a blinking (e.g., two consecutive blinks) of the LED module 134 at the most closely corresponding minute mark. As non-limiting examples, times may be indicated as shown in Table 3 below.

TABLE 3

| Time | Indication |
|---|---|
| 15:00 | LED at 3 o'clock long blink, followed by LED at 12 o'clock double blink |
| 15:15 | LED at 3 o'clock long blink, followed by LED at 3 o'clock double blink |
| 15:48 | LED at 3 o'clock long blink, followed by LED at 10 o'clock double blink |
| 15:45 | LED at 3 o'clock long blink, followed by LED at 9 o'clock double blink |
| 15:44 | LED at 3 o'clock long blink, followed by LED at 9 o'clock double blink |
| 15:43 | LED at 3 o'clock long blink, followed by LED at 9 o'clock double blink |
| 15:42 | LED at 3 o'clock long blink, followed by LED at 8 o'clock double blink |

The digital time may be equal to the time of an associated (e.g., "paired") smartphone or other device. The digital watch of the smartwatch assembly 200 may be used for the activity tracking, inactivity tracking, sunset, sunrise, alarm (s), etc. The digital time of the smartwatch assembly 200 may be automatically synced with the smartphone or other device whenever it is associated or otherwise paired with the smartphone or other device such that the digital time of the smartwatch assembly 200 is up to date, in case, for instance, the user changes time zones.

The smartwatch assembly 200 may track the activity of a user by counting the user's steps. The smartwatch assembly 200 may be capable of distinguishing the difference between running and walking by comparing the number of steps taken within a specified period of time. The user's weight, height, and gender may be considered in the algorithm for counting steps if the associated SW app allows the user to set a user profile including such information.

As a non-limiting example, the stride length formula may be defined as $S=H\times0.414$, where S is the stride length in centimeters and H is the height of the person in centimeters. If the user's height H is not defined in the user's specific data, the default H may be set to 0.73 cm for a male and 0.67 for a female. This formula may be used to provide a more detailed activity and inactivity tracking dataset. Whenever there is no height H specified, the formula cannot be applied, in which case the standard male or female standard may be used. If the gender also is not provided, the standard value of 0.73 cm is used, for example.

The user's calorie expenditure through activity may be calculated within the smartwatch assembly 200 as long as the weight, height and gender of the user is provided within the user's profile in the SW app.

Running may be defined as moving faster than a specified speed such as, for example, 4 Km/h. Walking may be defined as any speed slower than the specified speed. The user may be capable of setting one or more goals through the associated SW app. If the goal is achieved, an indication may be provided using the LED modules 134 and/or the vibrator 160 of the smartwatch assembly 200. For example, the indication may comprise blinking all of the white LED module 134 and vibrating for a specified time, such as three seconds. The progress of the activity to the goal may be indicated by pressing the first button control mechanism 118A, as indicated in Table 1 above. The LED modules 134 may be used to indicate the progress to the user. For example, the white LED modules 134 may be used to indicate the progress to the goal, and every white LED module 134 may represent 9% of the progress. The white LED modules 134 may start indicating at, for example, the 1 o'clock position. When the user's goal is reached, the full circle of white LED modules 134 may be illuminated. If the user surpasses the goal and then presses the first button control mechanism 118A, the full circle of white LED modules 134 will be illuminated once for each 100% of the goal achieved, and then the remaining fraction toward the full goal amount will be indicated as described above. Whenever the goal is achieved, 12 white LED modules 134 may be illuminated. Whenever 11 or fewer white LED modules 134 are illuminated, the goal has not been reached.

As previously mentioned, the smartwatch assembly 200 may be used to track the inactivity of the user. The user may wear the smartwatch assembly 200 while sleeping to track inactivity and, hence, quality of sleep. Inactivity tracking can be turned on by either holding the second button control mechanism 118B for a long press (e.g., two seconds) as indicated in Table 1 above, or by turning on the sleep alarm using an associated SW app. The 12 o'clock LED module 134 may blink green, for example, to indicate that the inactivity tracking has been turned on, and the 12 o'clock LED module 134 may blink red when the inactivity tracking is turned off.

The smartwatch assembly 200 may include an alarm feature. For example, the smartwatch assembly 200 may include, for example, seven usual wake up/normal alarms and seven sleep alarms for the user to track his or her sleep. If a normal alarm goes off, inactivity tracking may also be disabled if it was previously enabled. The alarm(s) may be configured through the associated SW app. The alarm(s) may be configured differently for each day of the week if desired.

The smartwatch assembly 200 may be used to provide indications to the user corresponding to notifications from an associated smartphone or other device, if connected to the smartwatch assembly 200. The indications may be provided to the user by way of the LED modules 134 and/or the vibrator 160 of the smartwatch assembly 200. As a non-limiting example, whenever a notification is received, the smartwatch assembly 200 may vibrate three times and the LED modules 134 may blink five times. For example, the smartwatch assembly 200 may notify the user upon receiving incoming notifications from the associated smartphone or other device, and also notify the user upon receiving an incoming call on the associated smartphone or other device. As a non-limiting example, the smartwatch assembly 200 may notify the user of incoming calls, SMS messages, email messages, chat instant messages (e.g., WeChat instant messages, WhatsApp instant messages, etc.), social media notifications (e.g., FACEBOOK® notifications, TWITTER® notifications, etc.), and calendar events.

The smartwatch assembly 200 may have a "Find My Phone" functionality, which can be actuated by double pressing the first button control mechanism 118A as indicated in Table 1, for example. The smartwatch assembly 200 may also be found through the SW app by actuating a "Find My Watch" function in the SW app. If the smartwatch assembly 200 receives the BLUETOOTH® signal corresponding to the Find My Watch function, the smartwatch assembly 200 may, for example, vibrate for three seconds and all the LED modules 134, including the RGB LED module 134, may blink white. Whenever the Find My Phone function is triggered from the smartwatch assembly 200, the smartphone or other associated device may vibrate and provide an audible sound signal.

The smartwatch assembly 200 may be configured to display local sunset and sunrise times by double pressing the second button control mechanism 118B, as indicated in Table 1 above. Upon actuation of this function, the smartwatch assembly 200 may first indicate the sunrise time by illuminating the RGB LED module 134 to blink yellow at the 12 o'clock position (yellow indicating that the sunrise time is to be displayed), and then indicating the hour and minutes of the sunrise time in the same manner previously described for indicating the time of the digital clock. After indicating the sunrise time, the RGB LED module 134 may be illuminated to blink blue at the 12 o'clock position (blue indicating that the sunset time is to be displayed), and then the hour and minutes of the sunset time may be indicated in the same manner previously described for indicating the time of the digital clock. The local sunset and sunrise times may be obtained from a remote server through the SW app on the associated smartphone or other device. A dataset of sunset and sunrise times may be obtained for a certain calendar period and stored in memory of the associated smartphone or other device and/or memory of the smartwatch assembly 200.

The smartwatch assembly 200 may be configured to display to the user detected local times as received from an associated smartphone or device, which may be used by the user to manually adjust the conventional clock of the watch to the correct local time. For example, when a user is traveling and changes time zones, the associated smartphone or device will typically automatically update its time to local time through the cellular network (e.g., GSM, CDMA, etc.) to which it is connected. The smartwatch assembly 200 may be programmed and configured to obtain the local time from the associated smartphone or device periodically and/or upon predefined events, and to compare the obtained local time with a previously logged local time. If a difference is detected, the newly detected local time may be indicated to the user using the LED modules and/or the vibrator. For example, upon detecting that the local time has changed, the smartwatch assembly 200 may vibrate for a period of time (e.g., three seconds), after which the RGB LED module may be illuminated with a specific color (e.g., green) to indicate that a newly detected local time is to be indicated, after which the hour and minutes of the new local time may be indicated in the same manner previously described for indicating the time of the digital clock. The user then may manually adjust the time of the conventional clock of the smartwatch assembly 200 to the new local time using the crown control mechanism 118C.

The remaining battery life of the smartwatch assembly 200 may also be calculated and indicated to the user using the LED modules 134 as a percentage in a similar manner to that described previously in relation to the percentage of activity goals achieved.

The smartwatch assembly 200 may be at least partially solar powered, as previously described in relation to the smartwatch assembly 100. For example, the face plate 144 of the dial portion 112 of the smartwatch assembly 200 and/or the transparent portion (i.e., front cover) may include solar cells. As a non-limiting example embodiment, the transparent portion 114 (i.e., front cover) may include a photovoltaic solar cell material layer that is generally transparent, such as that commercially available from Sunpartner Technologies of Rousset, France, under the tradename WYSIPS®.

Any other features or functionalities described in relation to the smartwatch assembly 100 may also be employed in the smartwatch assembly 200, and the features or functionalities described in relation to the smartwatch assembly 200 may also be employed in the smartwatch assembly 100.

FIGS. 11A-11H are screenshots of a display screen of a smartphone that may be operatively associated with the smartwatch assembly 200 and executing an SW app for the smartwatch assembly 200.

Figure 11A:
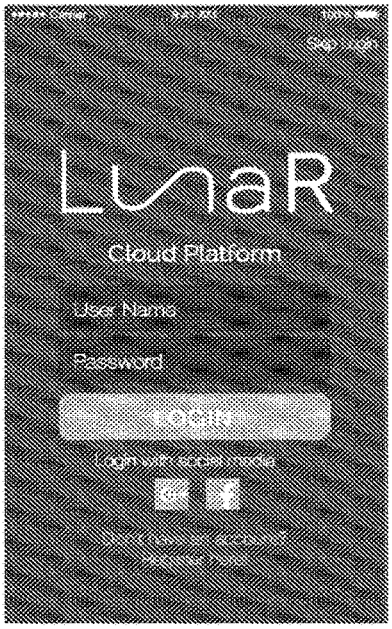
FIGS. 11A-11H illustrate screen shots of an application associated with the smartwatch assembly of FIG. 10 operating on a smartphone device operably coupled with the smartwatch assembly of FIG. 10.

FIG. 11A illustrates a login page that may be launched upon initially launching execution of the SW app on the smartphone. The login page allows a user to login to the SW app using a user name and password. The SW app may include stored information pertaining to the user's profile, as previously described herein.

Figure 11B:
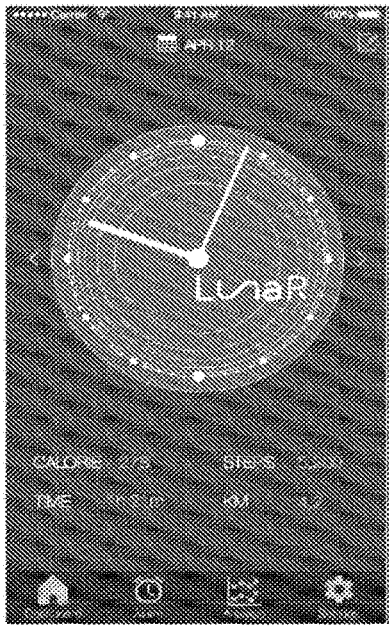
Figure 11C:
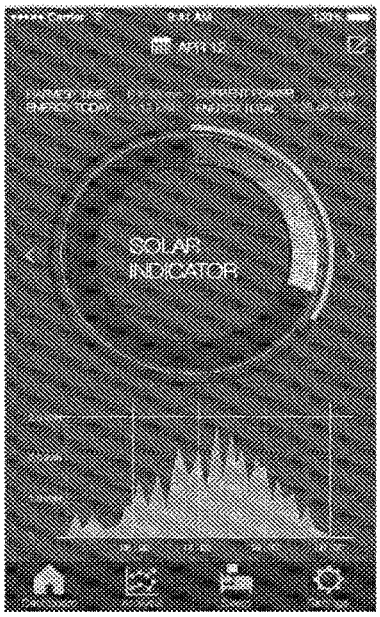

After login, the SW app may display a dashboard tool as illustrated in FIG. 11B. As shown therein, the dashboard tool may display the current time of the digital clock of the smartwatch assembly 200, the calories expended by the user for the day, the steps taken by the user during the day, the total active time of the user for the day, and the distance traveled by the user for the day. On the dashboard tool, the user may alter what is displayed in the main portion of the display screen. For example, the user may press the left and right directional arrows shown on the left and right sides, respectively, of the clock. FIG. 11C illustrates another screen that may be displayed on the dashboard tool. The data shown in FIG. 11C pertains to the solar cell device of the smartwatch assembly 200, and illustrates the total time during which electrical energy was harvested by the solar cell device, the current power output by the solar cell device, the daily total energy harvested by the solar cell device, and the total energy harvested by the solar cell device. The screenshot of FIG. 11C also illustrates a graph showing the energy harvested by the solar cell device as a function of time over a period of time, such as the preceding 24 hours. Any other data acquired by the smartwatch assembly 200 also may be displayed on the various dashboard tools of the SW app. As shown in the lower portion of the screenshot of FIG. 11C, the user may move between the dashboard tool, an alarm tool, an analysis tool, and a settings tool.

Figure 11D:
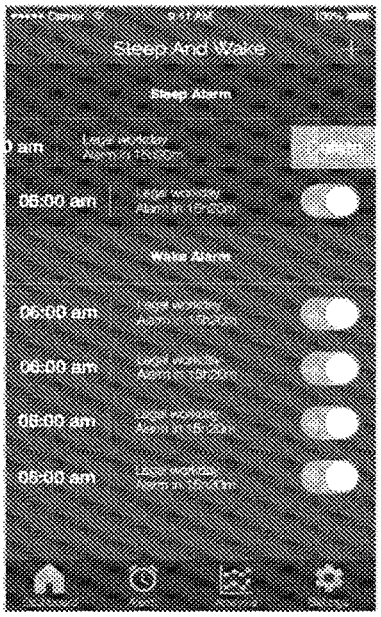

FIG. 11D illustrates the alarm tool of the SW app. As shown therein, the user may set one or more alarms at any time of day, and the alarms may be turned on or off by the user. When an alarm is set and turned on, the data pertaining to the alarm will be conveyed to the smartwatch assembly 200 by the SW app, and the smartwatch assembly 200 will alert the user at the time corresponding to the alarm as previously described herein.

Figure 11E:
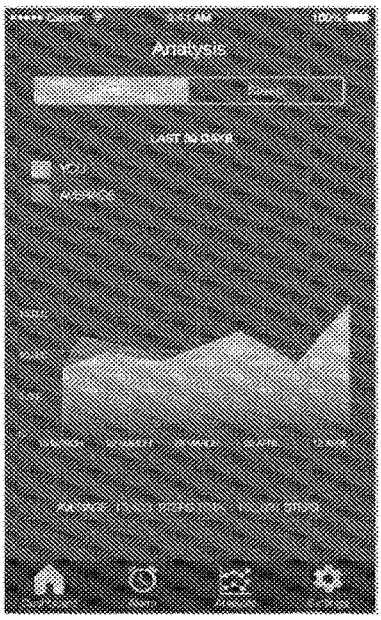

FIG. 11E illustrates one page of the analysis tool of the SW app. The page displayed in FIG. 11E corresponds to the steps taken by the user, as recorded by the smartwatch assembly 200. As shown in FIG. 11E, the steps page may include a graph showing the total steps of the user as a function of time, such as thirty days. The graph may also show the average steps of other users or all users of the SW app, which may be obtained from a remote server for example. In other embodiments, the graph could also display the user's step goals, if the user has input his or her step goals into the SW app. The steps page may also display the user's daily average steps over the time period, as well as the user's total steps over the time period.

Figure 11F:
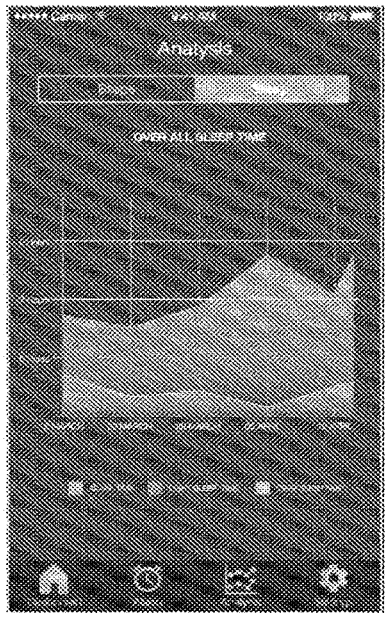

FIG. 11F illustrates a sleep page of the analysis tool. As shown therein, the sleep page may include a graph showing the total sleep time, the light sleep time, and the deep sleep time of the user over a period of time, such as thirty days. Additionally or in the alternative, the sleep page or another sleep page could display other sleep-related data, such as data pertaining to the average light, deep, and total sleep of other users of the SW app, which may be obtained from a remote server. In other embodiments, the graph could also display the user's sleep goals and progress toward such sleep goals, if the user has input his or her sleep goals into the SW app.

Figure 11G:
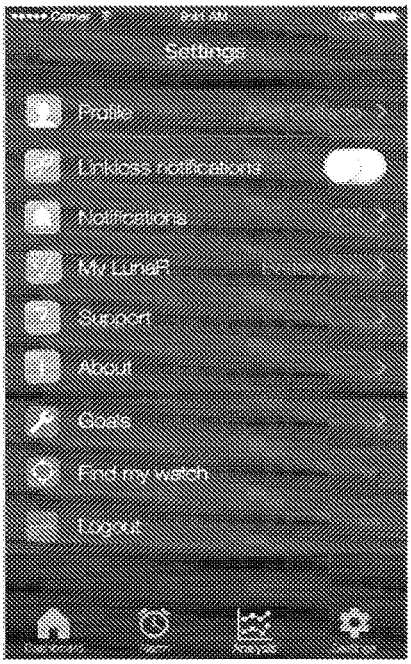
Figure 11H:
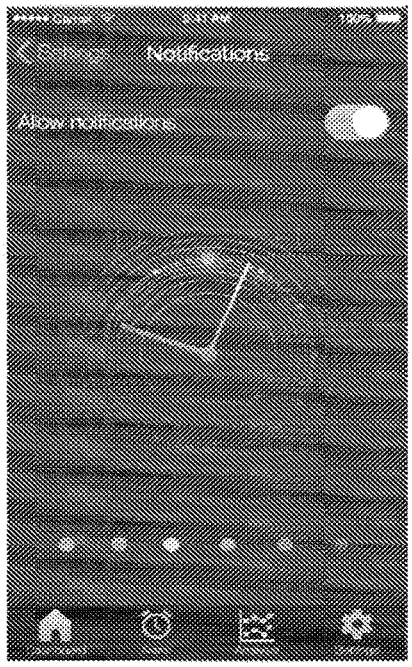

FIG. 11G illustrates a main page of the settings tool. As shown therein, from the setting tool, the user may adjust the settings within his or her profile (e.g., height, weight, gender, age, etc.). The user may also turn on or off various notifications to be indicated to the user by way of the smartwatch assembly 200. As shown in FIG. 11G, the user may also adjust his or her goals (activity goals, sleep goals, etc.) from within the settings tool, and may also initiate the Find My Watch function, which was previously described herein. FIG. 11H illustrates a screen that may be displayed when the user enters the notifications page from the main page of the settings tool. As shown therein, the user may choose to disallow or allow notifications to the user from this page, and may choose which colors to be displayed by the RGB LED module 134 at the 12 o'clock position of the smartwatch assembly 200 for the various notifications respectively.

Additional non-limiting example embodiments of the present disclosure are set forth below.

Embodiment 1

A smartwatch assembly, comprising: a watch casing; a dial portion disposed in the watch casing and having a plurality of hour mark apertures extending therethrough; and a circuit board disposed within the watch casing and having a plurality of LED modules disposed thereon, the plurality of LED modules oriented to emit light toward the plurality of hour mark apertures of the dial portion.

Embodiment 2

The smartwatch assembly of Embodiment 1, further comprising a light guide disposed between the dial portion and the circuit board, the light guide comprising: a plate portion; and a plurality of light guide holes extending through the plate portion, each light guide hole of the plurality of light guide holes corresponding to an LED module of the plurality of LED modules.

Embodiment 3

The smartwatch assembly of Embodiment 2, further comprising a light diffuser disposed between the light guide and the dial portion.

Embodiment 4

The smartwatch assembly of Embodiment 3, wherein the light diffuser comprises a MYLAR® film.

Embodiment 5

The smartwatch assembly of any one of Embodiments 1 through 4, further comprising a frame assembly disposed on a side of the circuit board opposite the dial portion, wherein the frame assembly includes a vibrator.

Embodiment 6

The smartwatch assembly of any one of Embodiments 1 through 5, wherein the plurality of LED modules comprises white LED modules.

Embodiment 7

The smartwatch assembly of any one of Embodiments 1 through 6, wherein the plurality of LED modules comprises colored LED modules.

Embodiment 8

The smartwatch assembly of any one of Embodiments 1 through 7, further comprising: a transparent portion attached to a first lateral side of the watch casing, wherein the dial portion of the smartwatch assembly is viewable through the transparent portion; and a back panel removably attached to a second lateral side of the watch casing opposite the first lateral side.

Embodiment 9

A smartwatch assembly, comprising: a watch casing; a dial portion disposed in the watch casing and comprising: a face plate; a plurality of hour mark apertures extending through the face plate; and an hour hand extending from a center of the face plate and pointing, at least generally, toward one or more of the hour mark apertures; and a circuit board disposed in the watch casing and comprising: a board portion; a plurality of LED modules disposed on the board portion and oriented to emit light through the plurality of hour mark apertures of the dial portion; a control module configured to illuminate at least one LED module of the plurality of LED modules in response to one or more alerts; and a communication module configured to interface with an electronic device wirelessly and to receive the one or more alerts.

Embodiment 10

The smartwatch assembly of Embodiment 9, wherein the one or more alerts include one or more of receiving an email, receiving a text, receiving a phone call, receiving a voicemail, an alarm, and a reminder on the electronic device.

Embodiment 11

The smartwatch assembly of Embodiment 9 or Embodiment 10, wherein the control module is configured to illuminate a first set of LED modules of the plurality of LED modules in response to a first alert and a second set of LED modules of the plurality of LED modules in response to a second alert.

Embodiment 12

The smartwatch assembly of any one of Embodiments 9 through 11, wherein the communication module is configured to communicate with the electronic device via low energy BLUETOOTH®.

Embodiment 13

The smartwatch assembly of any one of Embodiments 9 through 12, wherein the control module of the smartwatch assembly is further configured to track an activity of a user and to indicate progression of the activity by illuminating at least one of the plurality of LED modules.

Embodiment 14

The smartwatch assembly of Embodiment 13, wherein the activity of the user includes one or more of walking, running, swimming, and sleeping.

Embodiment 15

The smartwatch assembly of Embodiment 13 or Embodiment 14, wherein the control module of the smartwatch assembly tracks the activity of the user via an app on a smartphone.

Embodiment 16

The smartwatch assembly of any one of Embodiments 9 through 15, wherein the smartwatch assembly does not include an electronic display screen.

Embodiment 17

The smartwatch assembly of any one of Embodiments 9 through 16, wherein the communication module is configured to interface with a smartphone.

Embodiment 18

A method of making a smartwatch assembly, comprising: disposing a dial portion having a face plate and a plurality of hour mark apertures extending through the face plate in a watch casing; and disposing a circuit board having a plurality of LED modules disposed thereon in a watch casing, the plurality of LED modules corresponding to the plurality of hour mark apertures.

Embodiment 19

The method of making a smartwatch assembly of Embodiment 18, further comprising disposing a light guide having a plurality of light guide holes extending therethrough between the dial portion and the circuit board.

Embodiment 20

The method of making a smartwatch assembly of Embodiment 19, further comprising disposing a light diffuser over the plurality of light guide holes of the light guide and between the light guide and the dial portion.

Embodiment 21

A smartwatch assembly, comprising: a watch body; a dial portion disposed within the watch body and comprising: a face plate having a plurality of hour mark positions; an hour hand extending radially from a center of the face plate; and a minute hand extending radially from a center of the face plate; a plurality of light sources disposed within the watch body, the plurality of light sources being able to emit light of different colors; and a control module configured to illuminate one or more of the plurality of light sources, wherein the control module is configured to cause one or more of the plurality of light sources to emit a first color of light to indicate to a user a first notification from a smartphone in wireless communication with the smartwatch assembly and to cause one or more of the plurality of light sources to emit a second color of light to indicate to the user a second notification from the smartphone.

Embodiment 22

A smartwatch assembly, comprising: a watch casing; a dial portion disposed in the watch casing and having a plurality of hour-mark apertures extending therethrough; a circuit board disposed within the watch casing and including a processor and memory; a plurality of LED modules oriented to emit light toward the plurality of hour-mark apertures of the dial portion; an analog clock including an hour hand and a minute hand; and a digital clock; wherein the smartwatch assembly is configured to indicate time data to a user by illumination of one or more of the plurality of LED modules through the plurality of hour-mark apertures of the dial portion.

Embodiment 23

The smartwatch assembly of Embodiment 22, wherein the time data comprises a current local time of the digital clock.

Embodiment 24

The smartwatch assembly of Embodiment 23, wherein the smartwatch assembly is configured to wirelessly receive the current local time of the digital clock from a smartphone or other electronic device operatively associated with the smartwatch assembly.

Embodiment 25

The smartwatch assembly of any one of Embodiments 22 through 24, wherein the time data comprises at least one of a local sunrise time and a local sunset time.

Embodiment 26

The smartwatch assembly of Embodiment 25, wherein the smartwatch assembly is configured to wirelessly receive the at least one of a local sunrise time and a local sunset time from a smartphone or other electronic device operatively associated with the smartwatch assembly.

Embodiment 27

The smartwatch assembly of any one of Embodiments 22 through 26, wherein the smartwatch assembly is configured to indicate an hour of the time data to the user by illuminating one of the LED modules at an hour mark position corresponding to an hour of the time data, and to subsequently indicate a minute of the time data to the user by illuminating one or two of the LED modules at one or two of the hour mark position or positions most closely corresponding to a minute of the time data.

Embodiment 28

The smartwatch assembly of any one of Embodiments 22 through 27, further comprising: a transparent front cover disposed over the dial portion; and an at least partially transparent solar cell material on at least one of the dial portion and the transparent front cover, such that light emitted from the LED modules passes through the at least partially transparent solar cell material.

Embodiment 29

The smartwatch assembly of any one of Embodiments 22 through 28, wherein the plurality of LED modules comprises one or more white LED modules.

Embodiment 30

The smartwatch assembly of any one of Embodiments 22 through 29, wherein the plurality of LED modules comprises one or more colored LED modules.

Embodiment 31

The smartwatch assembly of any one of Embodiments 22 through 30, further comprising: a transparent front cover attached to a front side of the watch casing, wherein the dial portion of the smartwatch assembly is viewable through the transparent portion; and a back panel removably attached to a back side of the watch casing opposite the front side.

Embodiment 32

The smartwatch assembly of any one of Embodiments 22 through 31, wherein the smartwatch assembly does not include an electronic display screen.

Embodiment 33

A smartwatch assembly, comprising: a watch casing; a dial portion disposed in the watch casing and comprising: a face plate having a plurality of hour-mark apertures extending through the face plate at hour mark positions of an analog clock; an hour hand extending radially outwardly from a center of the face plate; and a minute hand extending radially outwardly from the center of the face plate; and a circuit board disposed in the watch casing and comprising: a board portion; a plurality of LED modules disposed on the board portion and oriented to emit light through the plurality of hour-mark apertures of the dial portion; a control module configured to control illumination of the LED modules in such a manner as to convey alerts and/or time data information to a user; and a communication module configured to wirelessly interface with an operatively associated electronic device; wherein at least some of the alerts and/or time data are received by the smartwatch assembly from the operatively associated electronic device.

Embodiment 34

The smartwatch assembly of Embodiment 33, wherein the control module is configured to control illumination of the LED modules in such a manner as to notify the user of at least one of the following: receipt of an email by the associated electronic device, receipt of a text message by the associated electronic device, receipt of an incoming telephone call by the associated electronic device, receipt of a voicemail by the associated electronic device, an alarm, and a calendar event.

Embodiment 35

The smartwatch assembly of Embodiment 33 or 34, wherein the control module is configured to track an activity of a user and to indicate progression of the activity by illuminating at least one of the plurality of LED modules.

Embodiment 36

The smartwatch assembly of Embodiment 35, wherein the activity of the user includes one or more of walking, running, swimming, and sleeping.

Embodiment 37

The smartwatch assembly of Embodiment 35 or 36, wherein the control module of the smartwatch assembly tracks the activity of the user via an application executed on a smartphone.

Embodiment 38

The smartwatch assembly of any one of Embodiments 33 through 37, wherein the operatively associated electronic device comprises a smartphone.

Embodiment 39

The smartwatch assembly of any one of Embodiments 33 through 38, wherein the smartwatch assembly does not include an electronic display screen.

Embodiment 40

A smartwatch assembly comprising an ECG sensor configured so as to be in contact with the user's skin and obtain an electrocardiogram measurement from the user while the user is wearing the smartwatch assembly.

Embodiment 41

The smartwatch assembly of Embodiment 40, wherein the ECG sensor is configured to measure parameters pertaining to the QRS complex of electrocardiogram data acquired from the user.

Embodiment 42

The smartwatch assembly of Embodiment 40 or Embodiment 41, wherein algorithms are stored in memory of the smartwatch assembly, the algorithms executed by a processor of the smartwatch assembly using acquired electrocardiogram data to provide information to the user pertaining to one or more of the following variables: heart rate, effective heart age, heart rate robustness, heart rate variability, quality of the electrocardiogram signal, parameters of the QRS complex, mood, fatigue, and stress.

Embodiment 43

The smartwatch assembly of any one of Embodiments 40 through 42, further comprising LED modules configured to provide feedback to the user while the user is attempting to use the ECG sensor.

Embodiment 44

The smartwatch assembly of Embodiment 43, wherein the LED modules are used to provide information to the user pertaining to one or more of the following variables: heart rate, effective heart age, heart rate robustness, heart rate variability, quality of the electrocardiogram signal, parameters of the QRS complex, mood, fatigue, and stress.

Embodiment 45

The smartwatch assembly of Embodiment 44, further configured to transmit data pertaining to the one or more variables to a smartphone or other associated device for viewing, review, and/or tracking by a user.

Embodiment 46

The smartwatch assembly of any one of Embodiments 40 through 45, wherein the ECG sensor is configured to detect that a user of the smartwatch assembly is possibly intoxicated. For example, algorithms have been disclosed for estimating intoxication using ECG data.

Embodiment 47

The smartwatch assembly of Embodiment 46, wherein the smartwatch assembly further includes motion sensors to detect that the user is potentially driving a vehicle and to alert the user if the ECG sensor determines that the user is potentially intoxicated.

Embodiment 48

The smartwatch assembly of any one of Embodiments 40 through 47, wherein the smartwatch assembly is configured to alert the user if the ECG sensor detects a heart irregularity in the user.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternative useful combinations of the elements described, will become apparent to those skilled in the art from the description. Such modifications and embodiments also fall within the scope of the appended claims and equivalents.

What is claimed is:

1. A smartwatch assembly, comprising:

a watch casing;

a circuit board disposed within the watch casing and including a control module;

at least one LED module operably coupled to the control module and oriented to emit light from the watch casing;

at least one sensor operably coupled to the control module;

an electrocardiogram sensor operably coupled to the control module, at least partially disposed within the watch casing, and at least partially exposed through the watch casing to contact a user's skin;

wherein the control module comprises:

at least one processor; and at least one non-transitory computer-readable storage medium storing instructions thereon that, when executed by the at least one processor, cause the control module to:

initiate an electrocardiogram measurement via the electrocardiogram sensor in response to an event detected by the at least one sensor.

2. The smartwatch assembly of claim 1, further comprising instructions that, when executed by the at least one processor, cause the control module to convey information relative to the electrocardiogram measurement via the at least one LED module.

3. The smartwatch assembly of claim 1, further comprising instructions that, when executed by the at least one processor, cause the control module to convey a positive indication relative to the electrocardiogram measurement to the user via the at least one LED module utilizing a first color and convey a negative indication relative to the electrocardiogram measurement to the user via the at least one LED module utilizing a second different color.

4. The smartwatch assembly of claim 3, wherein the negative indication represents a heart irregularity detected via the electrocardiogram measurement.

5. The smartwatch assembly of claim 4, wherein the detected heart irregularity includes at least one of intoxication, heart rate, fatigue, stress, heart rate robustness, heart rate variability, and parameters of a QRS complex.

6. The smartwatch assembly of claim 1, wherein at least a portion of the electrocardiogram sensor is exposed on a lateral side of the watch casing and configured to be accessible via an opposite hand of the user.

7. The smartwatch assembly of claim 1, wherein at least a portion of the electrocardiogram sensor is exposed through a back cover of the watch casing.

8. The smartwatch assembly of claim 1, further comprising instructions that, when executed by the at least one processor, cause the control module to initiate electrocardiogram measurements periodically based on an operational mode of the smartwatch assembly.

9. The smartwatch assembly of claim 1, wherein the at least one LED module comprises at least one green LED module, at least one amber LED module, and at least one red LED module.

10. A smartwatch assembly, comprising:

a control module;

at least one LED module operably coupled to the control module and configured to emit light; and an electrocardiogram sensor operably coupled to the control module, at least partially disposed within the watch casing, and at least partially exposed through the watch casing to contact a user's skin;

wherein the control module comprises:

at least one processor; and at least one non-transitory computer-readable storage medium storing instructions thereon that, when executed by the at least one processor, cause the control module to:

initiate an electrocardiogram measurement via the electrocardiogram sensor in response to a detected event, and convey a positive indication relative to the electrocardiogram measurement to the user via the at least one LED module utilizing a first color and convey a negative indication relative to the electrocardiogram measurement to the user via the at least one LED module utilizing a second different color.

11. The smartwatch assembly of claim 10, wherein the negative indication represents a heart irregularity detected via the electrocardiogram measurement.

12. The smartwatch assembly of claim 11, wherein the detected heart irregularity includes at least one of intoxication, heart rate, fatigue, stress, heart rate robustness, heart rate variability, and parameters of a QRS complex.

13. The smartwatch assembly of claim 10, wherein at least a portion of the electrocardiogram sensor is exposed on a lateral side of the watch casing and configured to be accessible via an opposite hand of the user.

14. The smartwatch assembly of claim 10, wherein at least a portion of the electrocardiogram sensor is exposed through a back cover of the watch casing.

15. The smartwatch assembly of claim 10, further comprising instructions that, when executed by the at least one processor, cause the control module to initiate electrocardiogram measurements periodically based on an operational mode of the smartwatch assembly.

16. The smartwatch assembly of claim 10, wherein the at least one LED module comprises at least one green LED module, at least one amber LED module, and at least one red LED module.

17. A smartwatch assembly, comprising:

at least one sensor coupled to a control module;

an electrocardiogram sensor operably coupled to the control module, at least partially disposed within the watch casing, and at least partially exposed through the watch casing to contact a user's skin;

wherein the control module comprises:

at least one processor; and at least one non-transitory computer-readable storage medium storing instructions thereon that, when executed by the at least one processor, cause the control module to:

initiate an electrocardiogram measurement via the electrocardiogram sensor in response to an event detected by the at least one sensor.

18. The smartwatch assembly of claim 17, further comprising instructions that, when executed by the at least one processor, cause the control module to convey a positive indication relative to the electrocardiogram measurement to the user via at least one LED module utilizing a first color and convey a negative indication relative to the electrocardiogram measurement to the user via the at least one LED module utilizing a second different color.

19. The smartwatch assembly of claim 18, wherein the negative indication represents a heart irregularity detected via the electrocardiogram measurement.

20. The smartwatch assembly of claim 18, further comprising instructions that, when executed by the at least one processor, cause the control module to initiate electrocardiogram measurements periodically based on an operational mode of the smartwatch assembly.

* * * * *